US009618907B2

(12) United States Patent
Su et al.

(10) Patent No.: US 9,618,907 B2
(45) Date of Patent: Apr. 11, 2017

(54) ELECTRONIC APPARATUS

(71) Applicant: Lenovo (Beijing) Co., Ltd., Beijing (CN)

(72) Inventors: Wei Su, Beijing (CN); Zhijun Gao, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 62 days.

(21) Appl. No.: 14/573,469

(22) Filed: Dec. 17, 2014

(65) Prior Publication Data

US 2016/0018790 A1 Jan. 21, 2016

(30) Foreign Application Priority Data

Jul. 18, 2014 (CN) ..... 2014 1 0345027
Jul. 28, 2014 (CN) ..... 2014 1 0363760

(51) Int. Cl.
*G04G 17/02* (2006.01)
*G04G 17/04* (2006.01)
*G04G 17/08* (2006.01)

(52) U.S. Cl.
CPC ..... *G04G 17/02* (2013.01); *G04G 17/045* (2013.01); *G04G 17/083* (2013.01)

(58) Field of Classification Search
CPC ..... G06F 1/163; G04G 17/083
USPC ..... 361/679.03, 679.09, 679.3
See application file for complete search history.

(56) References Cited

U.S. PATENT DOCUMENTS 5,604,688 A * 2/1997 Chu ..... G06F 15/0225 708/160
6,011,653 A 1/2000 Karasawa
7,128,460 B2 * 10/2006 Hosobuchi ..... G02B 6/0036 362/23.15
7,604,396 B1 * 10/2009 Karterman ..... G04B 37/0427 368/276

(Continued)

FOREIGN PATENT DOCUMENTS

JP H-10-228245 8/1998

OTHER PUBLICATIONS

Office Action dated Aug. 18, 2015 out of corresponding German Patent Application No. DE 10 2014 019 596.1 (19 pages including English translation).

*Primary Examiner* — Tuan T Dinh
*Assistant Examiner* — Mukund G Patel
(74) *Attorney, Agent, or Firm* — Brinks Gilson & Lione; G. Peter Nichols

(57) ABSTRACT

The present application discloses an electronic apparatus, comprising: a frame body, a fixing device, and a functional main body section. The fixing device is connected to the frame body, and used for fixing the electronic apparatus onto a support body. The frame body and the fixing device form a ring-like space when the electronic apparatus is fixed onto the support body by the fixing device. The functional main body section at least includes a first display module and a second display module, which are disposed in the frame body and stacked sequentially in a first direction. The electronic apparatus has a first cross section. The first cross section is a ring formed by sectioning the electronic apparatus in a direction perpendicular to the support body with the support body as a reference object, when the electronic apparatus is fixed onto the support body by the fixing device.

24 Claims, 17 Drawing Sheets

(56) References Cited

U.S. PATENT DOCUMENTS

| | | | | |
|---|---|---|---|---|
| 2012/0203076 | A1 | 8/2012 | Fatta | |
| 2012/0253485 | A1* | 10/2012 | Weast | G06F 1/163 700/91 |
| 2014/0078694 | A1* | 3/2014 | Wissmar | G04G 17/04 361/749 |
| 2015/0277841 | A1* | 10/2015 | Lanier | G06F 3/014 345/428 |

* cited by examiner

ELECTRONIC APPARATUS

This application claims priority to Chinese patent application No. 201410345027.4 filed on Jul. 18, 2014 and to Chinese patent application No. 201410363760.9 filed on Jul. 28, 2014 the entire contents of which are incorporated herein by reference.

BACKGROUND

The present application relates to an electronic technology, and more particularly, to an electronic apparatus.

At present, an intelligent wearable electronic apparatus such as a smart watch needs to show more and more comprehensive information in order to meet users' demand for the intelligent electronic apparatus. However, due to a limited size of the wearable electronic apparatus itself, a display area of a display equipped therewith is generally very small, which can only display limited information. Furthermore, due to the limited size of the wearable electronic apparatus itself, power that can be supplied by a battery equipped for a display device is generally limited.

To this end, it is necessary to provide an electronic apparatus which is capable of providing an image or a video display with a larger size and a higher resolution, or extending the standby time of the wearable electronic apparatus, regardless of the size of the wearable electronic apparatus itself.

SUMMARY

An embodiment of the present application provides an electronic apparatus. The electronic apparatus comprises a frame body, a fixing device, and a functional main body. The fixing device is connected to the frame body, for fixing the electronic apparatus onto a support body. The frame body and the fixing device form a ring-like space when the electronic apparatus is fixed onto the support body by the fixing device. The functional main body section at least includes a first display module and a second display module. The first display module is disposed in the frame body, and the second display module is disposed in the frame body. The first display module and the second display module are stacked sequentially in a first direction. The electronic apparatus has a first cross section. The first cross section is a ring formed by sectioning the electronic apparatus in a direction perpendicular to the support body with the support body as a reference object when the electronic apparatus is fixed onto the support body by the fixing device. The first direction is a direction from outside of the ring to inside of the ring and toward a center of the ring.

The above electronic apparatus provided by an embodiment of the present application comprises: a frame body, a fixing device, and a functional main body section. The fixing device is connected to the frame body, and is used for fixing the electronic apparatus onto a support body. The frame body and the fixing device form a ring-like space when the electronic apparatus is fixed onto the support body by the fixing device. The functional main body section at least includes a first display module and a second display module. The first display module and the second display module are disposed in the frame body; and the first display module and the second display module are stacked sequentially in a first direction. The technical solution provided by the embodiment of the present application has advantages of two aspects as follows. In a first aspect, since the first display module and the second display module are stacked in the first direction, the technical solution provided by the embodiment of the present application can save space, so that the electronic apparatus provided by the embodiment of the present application is more compact, portable and wearable. In a second aspect, since the first display module can display some basic information, and the second display module can carry more and more comprehensive detailed information, the electronic apparatus provided by the embodiment of the present application is capable of providing an image or a video display of a larger size and a higher resolution, regardless of the size of the wearable electronic apparatus itself.

According to another aspect of an embodiment of the present application, there is provided an electronic apparatus. The electronic apparatus comprises a frame body, a fixing device, and a functional main body section. The fixing device is connected to the frame body, the fixing device is used for fixing the electronic apparatus onto a support body. The frame body and the fixing device form a ring-like space when the electronic apparatus is fixed onto the support body by the fixing device; the functional main body section at least includes a display device having a low power consumption mode and a high power consumption mode, a first battery, a second battery and a control circuit. The display device is disposed in the frame body, and is used for displaying and outputting display content. The first battery is disposed in the frame body or disposed in the fixing device. The second battery is disposed in the frame body or disposed in the fixing device. The control circuit is disposed in the frame body or disposed in the fixing device. The control circuit is used for controlling the first battery to supply power for the display device when the display device is in the low power consumption mode, and controlling the second battery to supply power for the display device when the display device is in the high power consumption mode. In the electronic apparatus provided according to another aspect of the embodiment of the present application, the electronic apparatus is powered by different batteries with respect to different power consumption modes. Accordingly, a standby time of the electronic apparatus having a dual-mode display device is avoided, and user experience is improved.

BRIEF DESCRIPTION OF THE DRAWINGS

FIG. 1-2 is a second cross-sectional schematic diagram of the electronic apparatus according to the first embodiment of the present application;

FIG. 2-1 is a cross-sectional schematic diagram of an electronic apparatus according to a second embodiment of the present application;

FIG. 2-2 is a first schematic diagram of a frame body according to the second Embodiment of the present application;

FIG. 2-3 is a second schematic diagram of the frame body according to the second Embodiment of the present application;

FIG. 2-4 is a third schematic diagram of the frame body according to the second Embodiment of the present application;

FIG. 3-1 is a first cross-sectional schematic diagram of an electronic apparatus according to a third embodiment of the present application;

FIG. 3-2 is a composition structural schematic diagram of a second display module according to the third embodiment of the present application;

FIG. 3-3 is a cross-sectional schematic diagram of a protective layer according to the third embodiment of the present application;

FIG. 3-4 is a cross-sectional schematic diagram of a support structure according to the third embodiment of the present application;

FIG. 3-5 is a schematic diagram of the protective layer in a top view from a first direction according to the third embodiment of the present application;

FIG. 4 is a cross-sectional schematic diagram of an electronic apparatus according to a fourth embodiment of the present application;

FIG. 5-1 is a first composition structural schematic diagram of a second display module according to a fifth embodiment of the present application;

FIG. 5-2 is a second composition structural schematic diagram of the second display module according to the fifth embodiment of the present application;

FIG. 5-3 is a first stereoscopic schematic diagram of an electronic apparatus according to the fifth embodiment of the present application;

FIG. 5-4 is a scenario schematic diagram provided by the fifth embodiment of the present application;

FIG. 6-1 is a first cross-sectional schematic diagram of an electronic apparatus according to a sixth embodiment of the present application;

FIG. 6-2 is a second cross-sectional schematic diagram of the electronic apparatus according to the sixth embodiment of the present application;

FIG. 6-3 is a third cross-sectional schematic diagram of the electronic apparatus according to the sixth embodiment of the present application;

FIG. 6-4 is a fourth cross-sectional schematic diagram of the electronic apparatus according to the sixth embodiment of the present application;

FIG. 6-5 is a top-view schematic diagram of a display device in FIG. 6-1;

FIG. 6-6 is a first connection structural schematic diagram of a fixing device and a frame body according to the sixth embodiment of the present application;

FIG. 7-1 is a first composition structural schematic diagram of an electronic apparatus according to a seventh embodiment of the present application;

FIG. 7-2 is a second composition structural schematic diagram of the electronic apparatus according to the seventh embodiment of the present application;

FIG. 7-3 is a composition structural schematic diagram of a second display module according to the seventh embodiment of the present application;

FIG. 7-4 is a first schematic diagram of a frame body according to the seventh embodiment of the present application;

FIG. 7-5 is a second schematic diagram of the frame body according to the seventh embodiment of the present application;

FIG. 7-6 is a third schematic diagram of the frame body according to the seventh embodiment of the present application;

FIG. 8-1 is a first composition structural schematic diagram of a second display module according to an eighth embodiment of the present application;

FIG. 8-2 is a second composition structural schematic diagram of the second display module according to the eighth embodiment of the present application;

DETAILED DESCRIPTION

Hereinafter, technical solutions of the present application are further described in detail in conjunction with the accompanying drawings and specific embodiments.

First Embodiment

Figure 1:
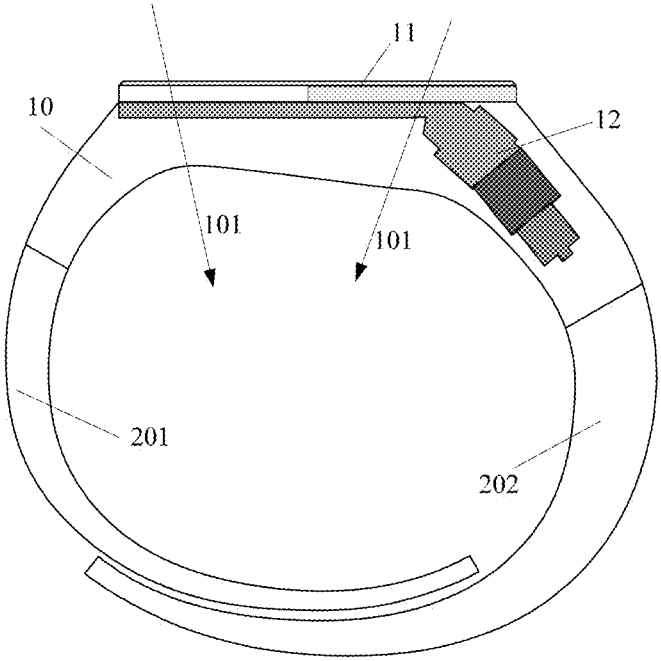
FIG. 1-1 is a first cross-sectional schematic diagram of an electronic apparatus according to a first embodiment of the present application.

This embodiment of the present application provides an electronic apparatus. FIG. 1-1 is a first cross-sectional schematic diagram of an electronic apparatus according to the first embodiment of the present application. As shown in FIG. 1-1, the electronic apparatus comprises a frame body 10, a fixing device and a functional main body section. The fixing device is connected to the frame body 10, and the fixing device is used for fixing the electronic apparatus onto a support body. The frame body and the fixing device form a ring-like space when the electronic apparatus is fixed onto the support body by the fixing device. The functional main body section at least includes a first display module 11 and a second display module 12. The first display module 11 is disposed in the frame body 10, and the second display module is disposed in the frame body 10. The first display module 11 and the second display module 12 are stacked sequentially in a first direction 101 (a direction shown by an arrow 101). The electronic apparatus has a first cross section. The first cross section is a ring formed by sectioning the electronic apparatus in a direction perpendicular to the support body with the support body as a reference object, when the electronic apparatus is fixed onto the support body by the fixing device. The first direction is a direction from outside of the ring to inside of the ring and toward a center of the ring.

In an embodiment of the present application, the electronic apparatus is a wearable electronic apparatus. As a more preferable embodiment, the electronic apparatus may be a smart watch. The first cross section may be understood as the cross section shown in FIG. 1-1; viewed from the cross section shown in FIG. 1-1, the frame body 10 and the fixing device in the electronic apparatus form a ring, which the support body can get through. When the ring is a standard circle, the first direction may be understood as a direction from outside of the circle to inside of the circle and toward a center of the circle. The ring is unlikely to be a standard circle, so the foregoing explanation of the first direction with the standard circle as an example only aims to illustrate the technical solution of the embodiment of the present application, rather than a real circumstance. The real circumstance is that, it is assumed that the smart watch is worn on a wrist; because a human wrist itself is not a standard cylinder, the ring formed by the smart watch is not a standard circle.

In one embodiment of the present application, the support body may either be a user's wrist, or be other part of the user's body. Of course, the support body may also be any object other than the user's body part. For example, it may be a prosthetic arm, etc., and may also be a hand lever on a bus or a subway train.

In an embodiment of the present application, the electronic apparatus is a wearable electronic apparatus. As a more preferable embodiment, the electronic apparatus may also be a smart ring. When the electronic apparatus is a smart ring, correspondingly, the support body may be a finger.

In one embodiment of the present application, the electronic apparatus, as shown in FIG. 1-1, comprise two fixing devices, which are a first fixing device 201 and a second fixing device 202. A first end of the first fixing device 201 is movably connected to a first end of the frame body 10. A first end of the second fixing device 202 is movably connected to a second end of the frame body 10, and a second end of the first fixing device 201 coordinates with a second end of the second fixing device 202 to fix the electronic apparatus onto the support body. In a specific implementation process, those skilled in the art can implement the coordination between the second end of the first fixing device 201 and the second end of the second fixing device 202 by a snap member, or an adhesive member or the like. Those skilled in the art can further implement a movable connection between the first end of the first fixing device 201 and the first end of the frame body 10, as well as a movable connection between the first end of the second fixing device 202 and the second end of the frame body 10 by a rotating shaft, which will not be described here.

Figures 1, 2:
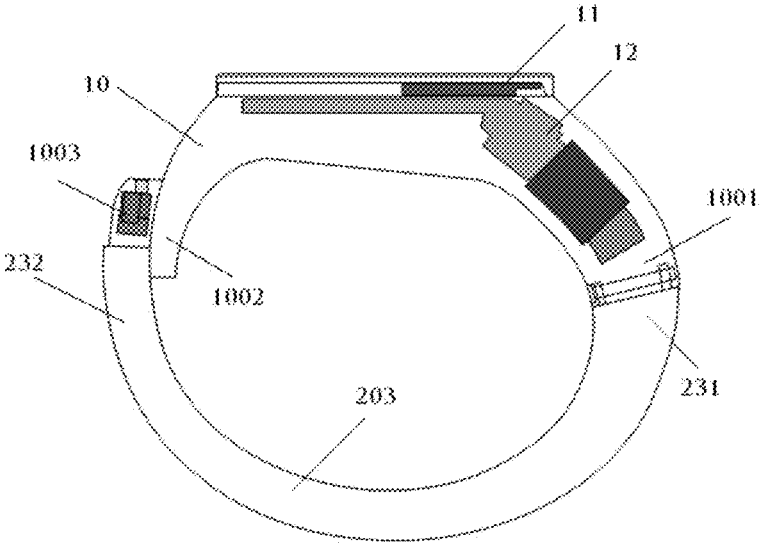

In one embodiment of the present application, as shown in FIG. 1-2, the electronic apparatus may further comprise only one fixing device which is a fixing device 203. A first end 231 of the fixing device 203 is movably connected to a first end 1001 of a frame body 10, a second end 232 of the fixing device 203 is fixed together with a second end 1002 of the frame body 10 by a snap member 1003.

The embodiment of the present application provides an electronic apparatus, comprising: a frame body, a fixing device and a functional main body section. The fixing device is connected to the frame body. The fixing device is used for fixing the electronic apparatus onto a support body, and the frame body and the fixing device forms a ring-like space when the electronic apparatus is fixed onto the support body by the fixing device. The functional main body section at least includes a first display module and a second display module. The first display module and the second display module is disposed in the frame body; and the first display module and the second display module is stacked sequentially in a first direction. On such basis, the technical solution provided by the embodiment of the present application has advantages described as follows. In a first aspect, since the first display module and the second display module are stacked in the first direction, the technical solution provided by the embodiment of the present application can save space, so that the electronic apparatus provided by the embodiment of the present application is more compact, portable and wearable.

In a second aspect, the first display module can display some basic information, and the second display module can carry more and more comprehensive detailed information. The basic information at least includes time, and may further include information such as date, temperature etc. The detailed information may be information generated based on the basic information. Of course, the detailed information may also be information that is not correlated with the basic information. Therefore, the electronic apparatus provided by the embodiment of the present application is capable of providing image or video display of a larger size and a higher resolution, regardless of the size of the wearable electronic apparatus itself.

Second Embodiment

Based on the above the first embodiment, the embodiment of the present application provides an electronic apparatus. FIG. 2-1 is a cross-sectional schematic diagram of the electronic apparatus according to the second embodiment of the present application. As shown in FIG. 2-1, the electronic apparatus comprises a frame body 10, a fixing device and a functional main body section. The fixing device is connected to the frame body 10, the fixing device is used for fixing the electronic apparatus onto a support body. The frame body and the fixing device form a ring-like space when the electronic apparatus is fixed onto the support body by the fixing device. The functional main body section at least includes a first display module 11 and a second display module 12. The first display module 11 is disposed in the frame body 10, and the second display module 12 is disposed in the frame body 10. The first display module 11 and the second display module 12 are stacked sequentially in a first direction 101 (the direction shown by an arrow 101). The electronic apparatus has a first cross section. The first cross section is a ring formed by sectioning the electronic apparatus in a direction perpendicular to the support body with the support body as a reference object, when the electronic apparatus is fixed onto the support body by the fixing device. The first direction is a direction from outside of the ring to inside of the ring and toward a center of the ring.

The frame body includes a main frame body. The main frame body is projected as a first shape on the support body, when the electronic apparatus is fixed onto the support body by the fixing device. Here, the first shape includes: a circle as shown in subfigure a in FIG. 2-1, a square as shown in subfigure b in FIG. 2-1, and a rectangle as shown in subfigure c in FIG. 2-1.

Now with the first shape being a circle as an example, the frame body 10 provided by the embodiment of the present application is specifically illustrated. The frame body 10 includes a main frame body and a sub frame body. The sub frame body may or may not exist. That is to say, the frame body 10 may include only the main frame body, at which time all the functional main body sections are disposed in the main frame body. In other words, the above-described first display module 11 and the second display module 12 are both disposed in the main frame body, and the above-described fixing device may be understood as a watchband of a smart watch. Of course, the smart watch may either include one watchband, or include two watchbands. When the smart watch only includes one watchband, the watchband at least includes a portion of a watch buckle thereon, while correspondingly another portion of the watch buckle is disposed on the main frame body. When the smart watch includes two watchbands which are a first watchband and a second watchband, a portion of the watch buckle is disposed on the first watchband, while correspondingly another portion of the watch buckle is disposed on the second watchband. As shown in FIG. 2-2, the frame body 10 only includes a main frame body 21, the main frame body 21 having a certain thickness, and thus includes two circles 2101 and 2102 as shown in FIG. 2-2. The first shape in subfigure a in FIG. 2-1 is a brief illustration, and actually, a projection of the main frame body on the support body as shown in FIG. 2-2 is similar to that as shown in FIG. 2-2. That is to say, the two circles 2101 and 2102 in FIG. 2-2 are incorporated into one circle which is the shape as shown in subfigure a in FIG. 2-1.

Figures 1, 2:
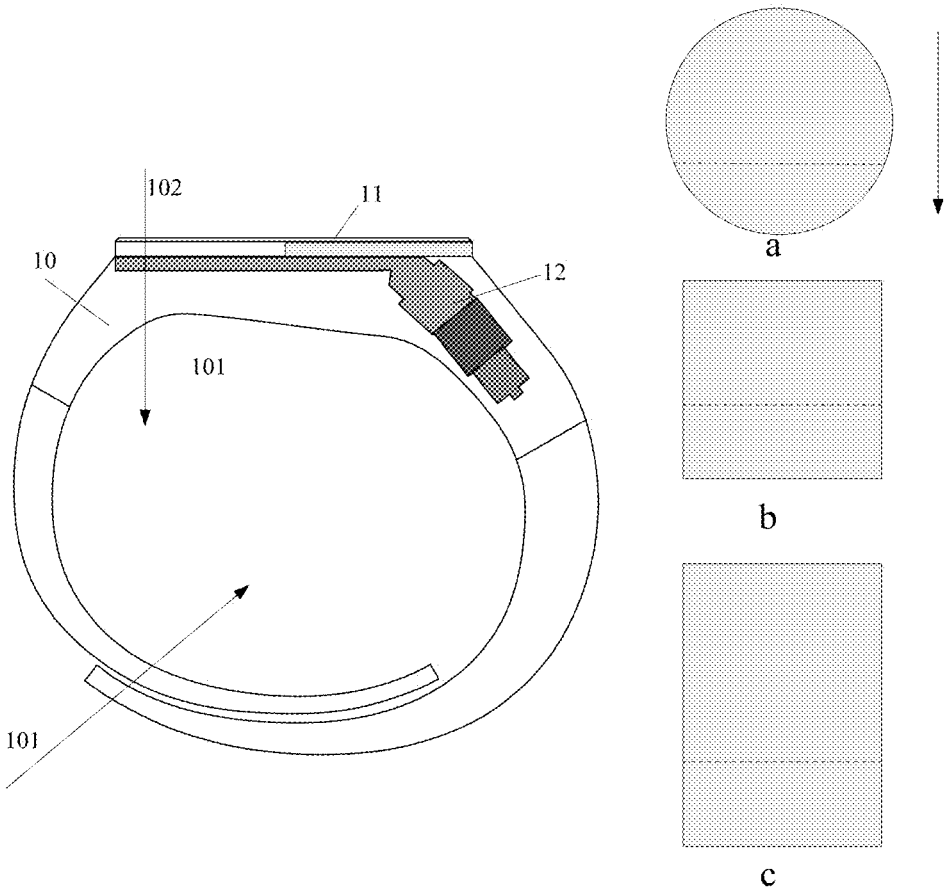
Figure 2:
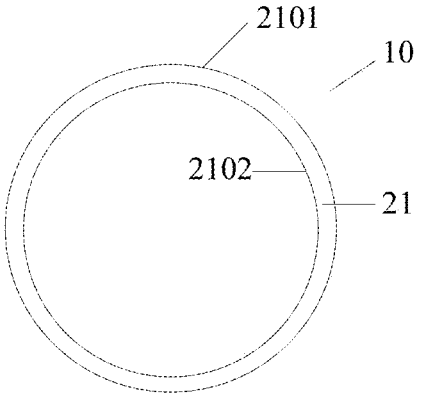
Figures 2, 3:
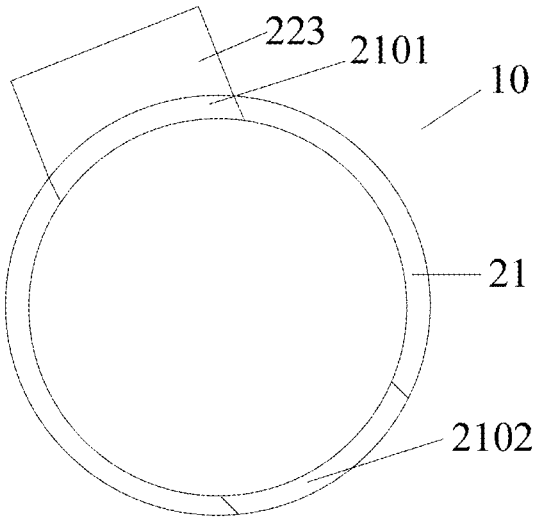

In one embodiment of the present application, the frame body may either include one sub frame body, or include two sub frame bodies. When the frame body includes one sub frame body, as shown in FIG. 2-3, the frame body 10 includes a main frame body 21 and a sub frame body 223. A first contact portion 2101 of the main frame body 21 is connected to an end of the sub frame body 223, and a second contact portion 2102 of the sub frame body 223 is connected to a fixing device. Of course, a number of the fixing device may be one or two, which, with reference to the first embodiment, will not be described here.

Figures 2, 3, 4:
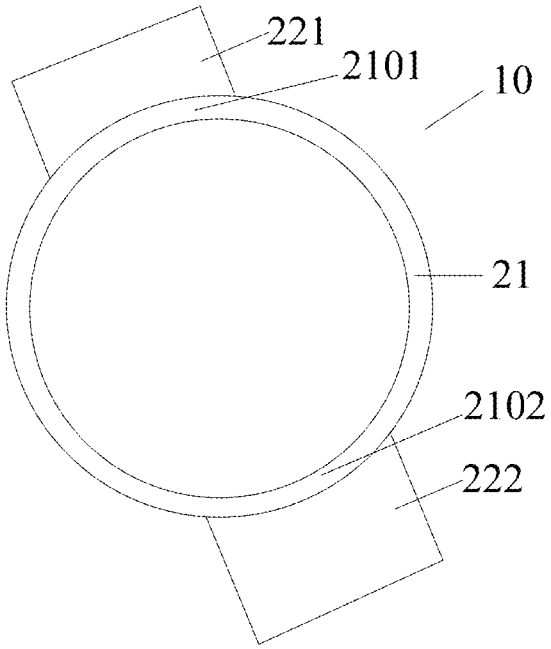

When the frame body includes two sub frame bodies, as shown in FIG. 2-4, the frame body includes a main frame body 21, a first sub frame body 221 and a second sub frame body 222. A first end of the first sub frame body 221 is connected to a first contact portion 2101 of the main frame body 21. A first end of the second sub frame body 221 is connected to a second contact portion 2102 of the main frame body 21. A fixing device is connected between a second end of the first sub frame body 221 and a second end of the second sub frame body 222. Of course, a number of the fixing device may be one or two, which may be with reference to the first embodiment, and will not be described here.

In cases as shown in FIG. 2-3 and FIG. 2-4, that is to say, when the frame body includes at least one sub frame body besides a main frame body, functional modules included in the functional main body section are respectively disposed in the main frame body and the sub frame body; in other words, the first display module 11 and the second display module 12 described above may be disposed in the main frame body and the sub frame body. In such case, the sub frame body becomes a portion of the watchband of the smart watch shown in FIG. 2-2.

When the frame body further includes a sub frame body, the sub frame body and the main frame body are formed integrally.

Third Embodiment

Based on the above the second embodiment, this embodiment of the present application further provides an electronic apparatus. FIG. 3-1 is a cross-sectional schematic diagram of the electronic apparatus according to the third embodiment of the present application. As shown in FIG. 3-1, the electronic apparatus comprises a frame body 10; a fixing device and a functional main body section. The fixing device is connected to the frame body 10, the fixing device is used for fixing the electronic apparatus onto a support body. The frame body and the fixing device form a ring-like space, when the electronic apparatus is fixed onto the support body by the fixing device. The functional main body section at least includes a first display module 11 and a second display module 12. The first display module 11 is disposed in the frame body 10. The second display module 12 is disposed in the frame body 10. The first display module 11 and the second display module 12 are stacked sequentially in a first direction 101 (the direction shown by an arrow 101). The electronic apparatus has a first cross section. The first cross section is a ring formed by sectioning the electronic apparatus in a direction perpendicular to the support body with the support body as a reference object, when the electronic apparatus is fixed onto the support body by the fixing device. The first direction is a direction from outside of the ring to inside of the ring and toward a center of the ring.

The first display module 11 occupies a first portion of a region formed by the first shape, and a first portion of the second display module 12 occupies a second portion of the region formed by the first shape. An area of the second portion of the region is larger than an area of the first portion of the region. The first display module 11 and the first portion of the second display module 12 are stacked sequentially according to the first direction.

In one embodiment of the present application, the first display module 11 is a first display screen, and used for displaying and outputting a first to-be-displayed content, and a size of the first display screen is a first display output region of the first display module; the second display module 12 is an optical projection system, as shown in FIG. 3-2, the second display module 12 includes a first portion 13 and a second portion. The first portion 13 of the second display module is an optical conduction component, and the second portion of the second display module includes a display component 15 and a collimating component 14. The display component 15 is used for displaying and outputting a second to-be-displayed content, to project a first light beam in a beam mode and output the first light beam to the collimating component 14. The collimating component 14 is used for processing the first light beam projected and outputted in the beam mode, to convert the first light beam into a second light beam and output the second light beam to the optical conduction component 13. The optical conduction component 13 is also called as an optical path conversion component. The optical conduction component is made of a transparent material, and the optical conduction component 13 is used for conducting the second light beam in the material which the optical conduction component is made of. The optical conduction component includes a reflecting unit. The reflecting unit is disposed in a specific region of an excess portion, is for changing a conducting direction of the second light beam in the transparent material, to be projected in a second direction. The second direction is consistent with an output direction of the first to-be-displayed content of the first display screen of the first display module. The specific region provided with the reflecting unit in the optical conduction component is a second display output region of the second display module.

In an embodiment of the present application, the frame body further includes a sub frame body, the sub frame body and the main frame body is formed integrally. A second portion of the second display module 12 is at least disposed in the sub frame body.

With reference further to FIG. 3-1, the electronic apparatus further comprises a protective layer 110, which is made of a transparent material. The protective layer 110 is disposed in the main frame body 10. A shape of the protective layer 110 is consistent with the first shape, and the protective layer occupies the whole region formed by the first shape. The protective layer 110, the first display module 11 and the first portion of the second display module 12 are stacked sequentially according to the first direction; and the protective layer is used for protecting the first display module and the first portion of the second display module.

Here, the first shape at least includes a circle as shown in subfigure a in FIG. 2-1, a square as shown in subfigure b in FIG. 2-1, and a rectangle as shown in subfigure c in FIG. 2-1.

Here, the protective layer may be made of a transparent material, such as transparent glass or plastic.

Figures 1, 3:
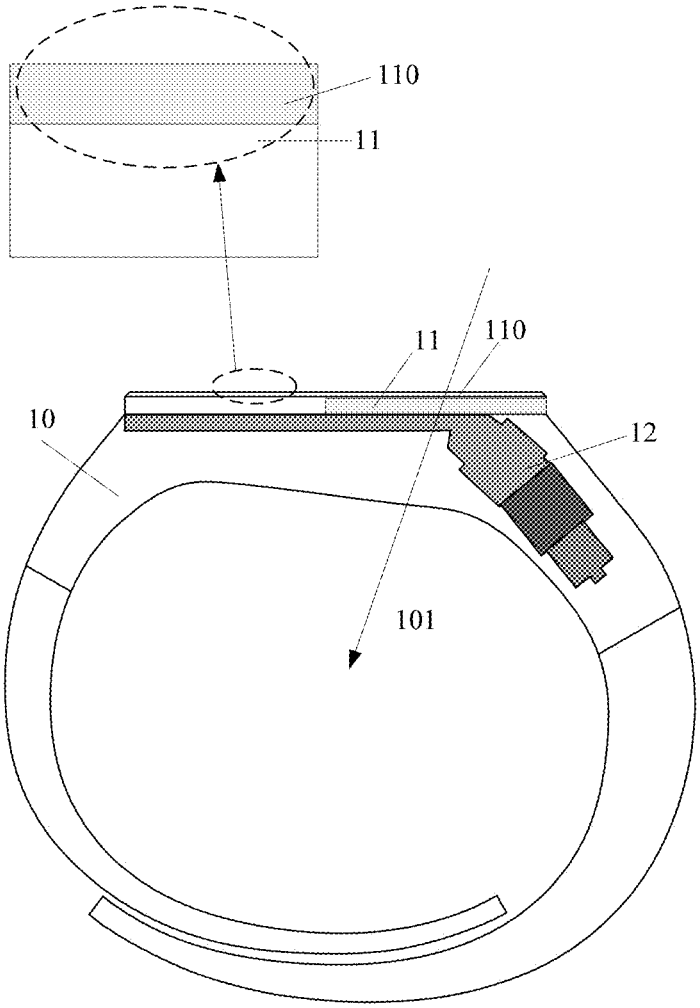
Figures 2, 3:
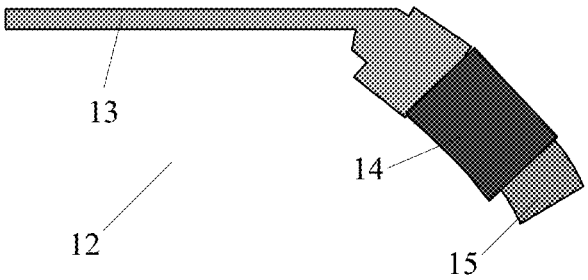
Figure 3:
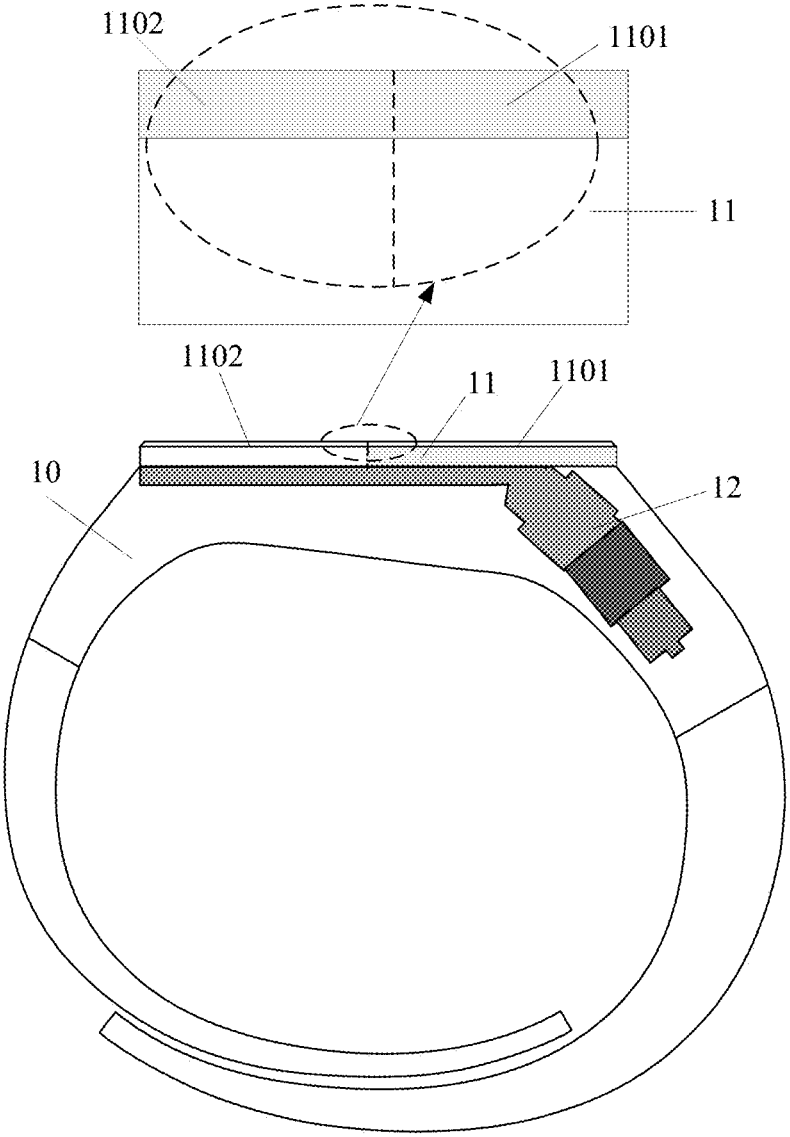
Figures 3, 4:
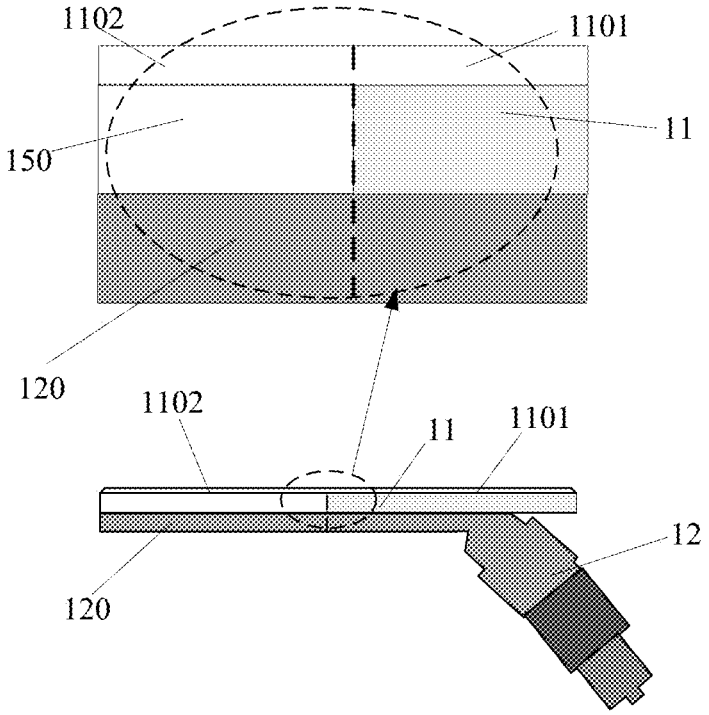
Figures 3, 4, 5:
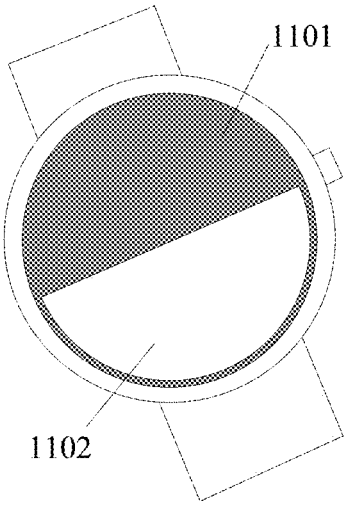
Figure 4:
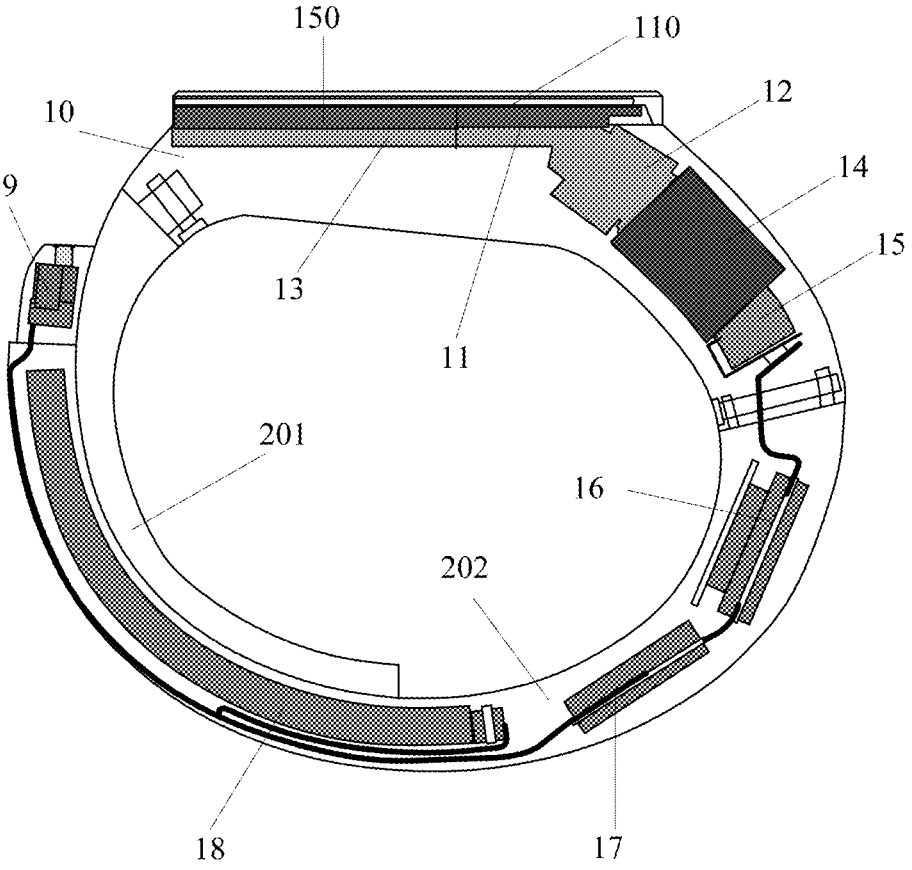
Figures 1, 5:
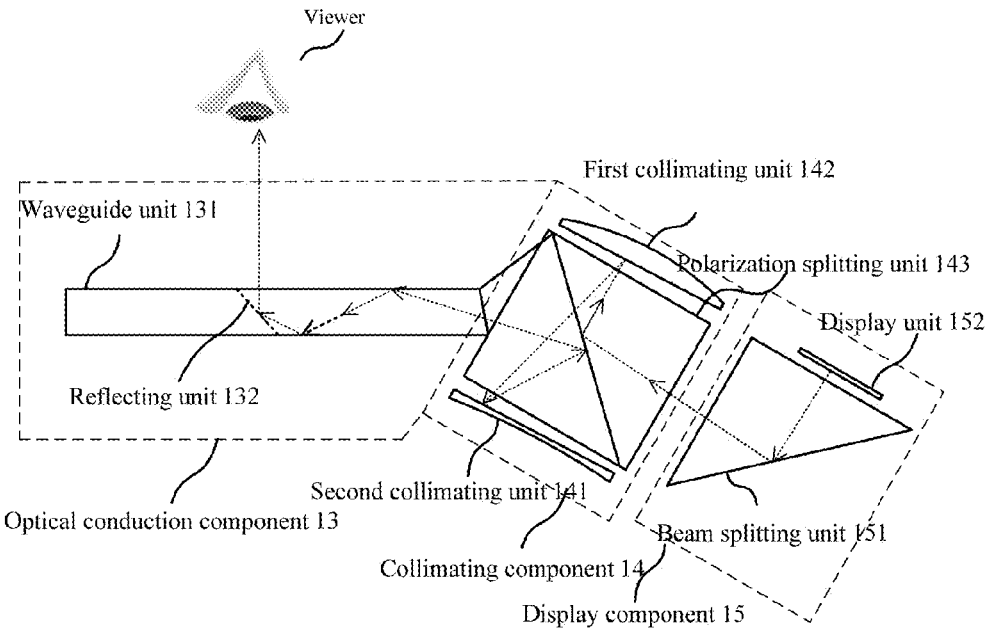
Figures 2, 5:
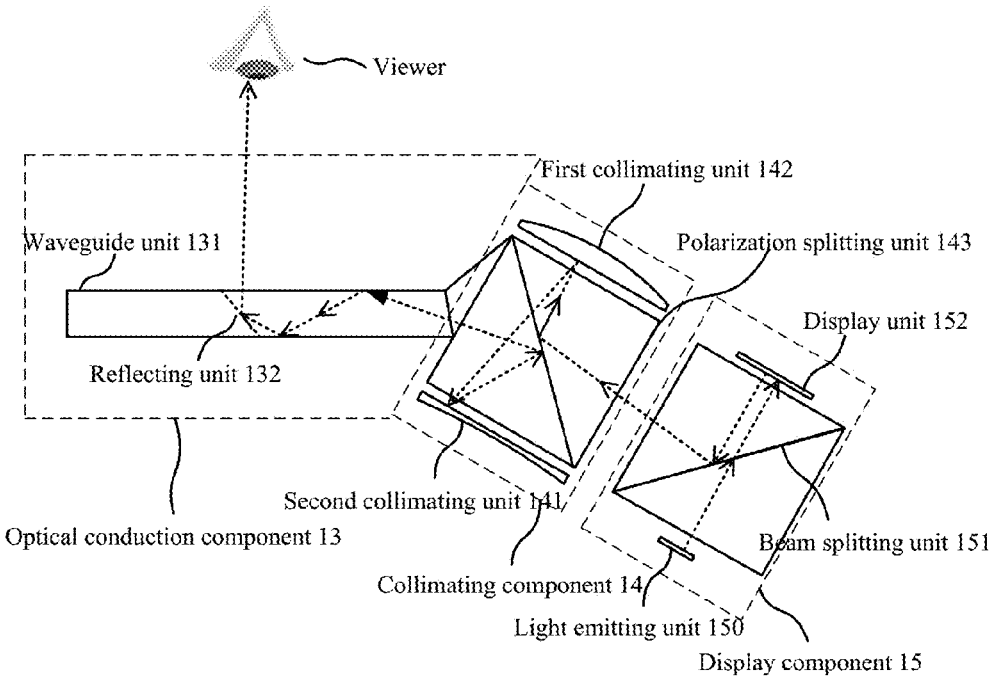
Figures 3, 5:
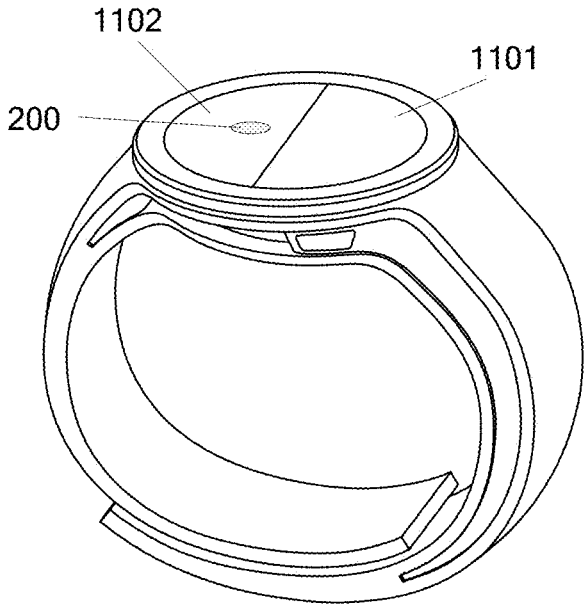
Figures 4, 5:
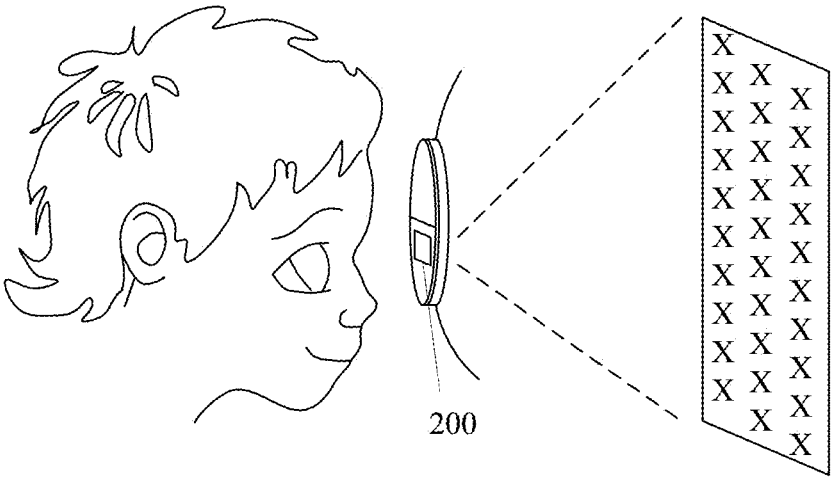

As shown in the FIG. 3-3 and FIG. 3-5, the protection layer 110 includes a first protection region 1101 and a second protection region 1102. The first display output region of the first display module corresponds to the first protection region 1101; the second display output region of the second display module corresponds to the second protection region 1102. The first protection region is an orthographic projection region of the first display output region on the protective layer. The second protection region includes an orthographic projection region of the second display output region on the protective layer. The first protection region 1101 and the second protection region 1102 are disposed in parallel. Because the orthographic projection region of the first display output region on the protective layer and the orthographic projection region of the second display output region on the protective layer are in parallel, the first display output region and the second display output region are also disposed in parallel, and the user can see the first to-be-displayed content output by the first display output region and the second to-be-displayed content output by the second display output region at the same time through the protective layer. It should be noted that dotted lines in FIG. 3-3 are not formed in a specific implementation procedure; instead, the dotted lines are mainly used for helping to understand the technical solution of the present embodiment. That is, in the specific implementation procedure, the first protection region 1101 and the second protection region 1102 are not segmented physically, and the protection layer 110 is a whole.

In an embodiment of the present application, as shown in FIG. 3-4, the first protection region 1101 corresponds to the first display module 11, and the second protection region 1102 corresponds to an excess portion 120. The excess portion 120 is a portion in the first portion of the second display module that exceeds the first display module.

With reference further to FIG. 3-4, as a preferable embodiment, the electronic apparatus further comprises a support structure 150, which is made of a transparent material. The support structure 150 is disposed in the main frame body, and the support structure 150 and the first display module 11 are disposed in parallel. The support structure 150 is located between the protective layer 110 and the excess portion 120, for supporting the protective layer and the excess portion, in order to enhance strength of the protective layer 110 and the excess portion 120.

It should be noted that, the electronic apparatus may not include a support structure. When the support structure is not included, there is a hollow structure between the protective layer and the excess portion. Therefore, strength of the protective layer in this embodiment is less than strength of the protective layer 110 in the embodiment shown in FIG. 3-4. Likewise, strength of the excess portion in this embodiment is less than strength of the excess portion 120 in the embodiment shown in FIG. 3-4.

In an embodiment of the present application, the functional main body section further includes: a mainboard module, a battery module and a flexible connecting line. The fixing device includes a connecting band which is made of a flexible material and a locking mechanism. The connecting band is movably connected to the frame body; and the connecting band is fixedly connected to the locking mechanism.

The connecting band has an accommodating space. The mainboard module and the battery module are sequentially disposed in the accommodating space in parallel in accordance with a shape of the accommodating space. The battery module is electrically connected to a first end of the mainboard module through the flexible connecting line; a second end of the mainboard module is led out of the accommodating space of the connecting band through the flexible connecting line and is led into the frame body, to be electrically connected to the first display module and the second display module, respectively.

In an embodiment of the present application, the mainboard module is divided into at least two portions, the at least two portions of the mainboard module is connected with the flexible connecting line between them, so that the mainboard module coordinates with deformation of the connecting band. In another embodiment of the present application, the battery module is divided into at least two portions, the at least two portions of the battery module is connected by the flexible connecting line, so that the battery module coordinates with deformation of the connecting band.

In an embodiment of the present application, the functional main body section further includes a data interface, for transmitting data and/or transmitting power; the data interface is disposed in the locking device. The data interface is connected to the battery module through the flexible connecting line; and/or the data interface is connected to the mainboard module through the flexible connecting line.

As can be seen from the above description, in the technical solution provided by the embodiment of the present application, the first display module 11 and the second display module 12 are stacked in the first direction, and the first display output region of the first display module 11 and the second display output region of the second display module 12 are disposed in parallel. Thereby, the above stacking mode and the parallel disposition mode can save space, so that the electronic apparatus provided by the embodiment of the present application is more compact, portable and wearable.

Fourth Embodiment

Based on the above embodiments, this embodiment of the present application further provides an electronic apparatus. FIG. 4 is a cross-sectional schematic diagram of the electronic apparatus according to the fourth embodiment of the present application. As shown in FIG. 4, the electronic apparatus comprises a frame body 10, a fixing device and a functional main body section. The fixing device is connected to the frame body 10, the fixing device is used for fixing the electronic apparatus onto a support body. The frame body and the fixing device form a ring-like space, when the electronic apparatus is fixed onto the support body by the fixing device. The functional main body section at least includes a first display module 11 and a second display module 12. The first display module 11 is disposed in the frame body 10, and the second display module 12 is disposed in the frame body 10. The first display module 11 and the second display module 12 are stacked sequentially in a first direction 101 (the direction shown by an arrow 101). The electronic apparatus has a first cross section. The first cross section is a ring formed by sectioning the electronic apparatus in a direction perpendicular to the support body with the support body as a reference object, when the electronic apparatus is fixed onto the support body by the fixing device. The first direction is a direction from outside of the ring to inside of the ring and toward a center of the ring.

In one embodiment of the present application, the functional main body section further includes a mainboard module and a battery module; the mainboard module and the battery module are disposed in the sub frame body, and the battery module are electrically connected to the mainboard module; and the mainboard module are electrically connected to the first display module and the second display module, respectively.

In another embodiment of the present application, of course, the mainboard module and the battery module may also be disposed in the fixing device. As shown in FIG. 4, the electronic apparatus comprises a first fixing device 201 and a second fixing device 202, the mainboard module 16 and the battery module 17 are disposed in the second fixing device 202, the battery module 17 is electrically connected to the mainboard module 16, and the mainboard module 16 is electrically connected to the first display module 11 and the second display module 12, respectively.

In an embodiment of the present application, the battery module 17 may either be a disposable button battery, or be a rechargeable battery, and the rechargeable battery may be a lithium battery, etc. In the embodiment shown in FIG. 4, the electronic apparatus further comprises a standby battery 18, and the standby battery 18 may be a flexible battery, such that the second fixing device 202 of the electronic apparatus can be arbitrarily bent.

In one embodiment of the present application, the fixing device may be a connecting band which is made of a flexible material. The connecting band is movably connected to the frame body. Or, the fixing device may further include several connecting bands made of a plurality of flexible materials and several locking mechanisms. One end of the first connecting band is movably connected to the frame body, and the other end of the first connecting band is movably connected to a connecting band by a locking mechanism. In the same way, respective connecting bands are movably connected to each other by the locking mechanisms, and the last connecting band is connected to the frame body.

In an embodiment of the present application, the mainboard module may be divided into at least two portions, the at least two portions of the mainboard module are connected with the flexible connecting line, so that the mainboard module coordinates with deformation of the connecting band. In another embodiment of the present application, the battery module is divided into at least two portions, the at least two portions of the battery module is connected with the flexible connecting line, so that the battery module coordinates with deformation of the connecting band.

In the embodiment as shown in FIG. 4, the functional main body section further includes a data interface 19, which is used for transmitting data and/or transmitting power; the data interface is disposed in the fixing device. The data interface is connected to the battery module through the flexible connecting line; and/or the data interface is connected to the mainboard module through the flexible connecting line.

Here, the data interface 19 may be a Universal Serial Bus (USB) interface, which can be used for charging other electronic apparatuses, or can be used for transmitting data between electronic apparatuses.

In one embodiment of the present application, the frame body includes a main frame body. The main frame body is projected as a first shape on the support body, when the electronic apparatus is fixed onto the support body by the fixing device.

In one embodiment of the present application, the first display module occupies a first portion of a region formed by the first shape, and a first portion of the second display module occupies a second portion of the region formed by the first shape. An area of the second portion of the region is larger than an area of the first portion of the region. The first display module and the first portion of the second display module are stacked sequentially according to the first direction.

In one embodiment of the present application, the electronic apparatus further comprises a protective layer, which is made of a transparent material. The protective layer is disposed in the main frame body, a shape of the protective layer is consistent with the first shape, and the protective layer occupying the whole region formed by the first shape. The protective layer, the first display module and the first portion of the second display module are stacked sequentially according to the first direction; and the protective layer is used for protecting the first display module and the first portion of the second display module.

In one embodiment of the present application, the protection layer includes a first protection region and a second protection region. A first display output region of the first display module corresponds to the first protection region. A second display output region of the second display module corresponds to the second protection region. The first protection region and the second protection region are disposed in parallel. Correspondingly, the first display output region and the second display output region are also disposed in parallel.

In one embodiment of the present application, the first protection region corresponds to the first display module, and the second protection region corresponds to an excess portion. The excess portion is a portion in the first portion of the second display module that exceeds the first display module.

In one embodiment of the present application, the electronic apparatus further comprises a support structure which is made of a transparent material. The support structure is disposed in the main frame body, and the support structure and the first display module are disposed in parallel. The support structure is located between the protective layer and the excess portion, and the support structure is used for supporting the protective layer and the excess portion, in order to enhance strength of the protective layer and the excess portion.

In one embodiment of the present application, the frame body further includes a sub frame body. The sub frame body and the main frame body are formed integrally. A second portion of the second display module is at least disposed in the sub frame body.

In one embodiment of the present application, the first display module is a first display screen, the first display screen is used for displaying and outputting a first to-be-displayed content. A size of the first display screen is a first display output region of the first display module. The second display module is an optical projection system. A first portion of the second display module is an optical conduction component, and a second portion of the second display module is a display component and a collimating component. The optical conduction component is made of a transparent material. The display component is used for displaying and outputting a second to-be-displayed content, to project a first light beam in a beam mode. The collimating component is used for processing the first light beam projected and outputted in the beam mode, to convert the first light beam into a second light beam and output the second light beam. The optical conduction component is used for conducting the second light beam in the material which the optical conduction component is made of. The optical conduction component includes a reflecting unit, which is disposed in the excess portion and for changing a conducting direction of the second light beam in the transparent material, to be projected in a second direction. The second direction is consistent with an output direction of the first to-be-displayed content of the first display screen of the first display module; and the specific region provided with the reflecting unit in the optical conduction component is a second display output region of the second display module.

Fifth Embodiment

Based on the above first embodiment, this embodiment of the present application provides an electronic apparatus, as shown in FIG. 1-1, the electronic apparatus comprising a frame body 10, a fixing device and a functional main body section. The fixing device is connected to the frame body 10, the fixing device is used for fixing the electronic apparatus onto a support body. The frame body and the fixing device form a ring-like space when the electronic apparatus is fixed onto the support body by the fixing device. The functional main body section at least includes a first display module 11 and a second display module 12. The first display module 11 is disposed in the frame body 10, and the second display module is disposed in the frame body 10. The first display module 11 and the second display module 12 are stacked sequentially in a first direction 101 (the direction shown by an arrow 101). The electronic apparatus has a first cross section. The first cross section is a ring formed by sectioning the electronic apparatus in a direction perpendicular to the support body with the support body as a reference object, when the electronic apparatus is fixed onto the support body by the fixing device. The first direction is a direction from outside of the ring to inside of the ring and toward a center of the ring.

The frame body includes a main frame body. The main frame body is projected as a first shape on the support body, when the electronic apparatus is fixed onto the support body by the fixing device. Here, the first shape includes: a circle as shown in subfigure a in FIG. 2-1, a square as shown in subfigure b in FIG. 2-1, and a rectangle as shown in subfigure c in FIG. 2-1.

The first display module 11 is a first display screen. The first display screen is used for displaying and outputting a first to-be-displayed content. A size of the first display screen is a first display output region of the first display module. The second display module 12 is an optical projection system, as shown in FIG. 3-2, the second display module 12 includes a first portion 13 and a second portion. The first portion 13 of the second display module is an optical conduction component, and the second portion of the second display module includes a display component 15 and a collimating component 14. The display component 15 is used for displaying and outputting a second to-be-displayed content, to project a first light beam in a beam mode and output the first light beam to the collimating component 14. The collimating component 14 is used for processing the first light beam projected and outputted in the beam mode, to convert the first light beam into a second light beam and output the second light beam to the optical conduction component 13. The optical conduction component 13 is also called as an optical path conversion component, the optical conduction component is made of a transparent material, and the optical conduction component 13 is used for conducting the second light beam in the material which the optical conduction component is made of, and finally outputting the second light beam to a viewer. The optical conduction component includes a reflecting unit, which is disposed in a specific region of the excess portion and for changing a conducting direction of the second light beam in the transparent material, to be projected in a second direction. The second direction is consistent with an output direction of the first to-be-displayed content of the first display screen of the first display module. The specific region provided with the reflecting unit in the optical conduction component 13 is a second display output region of the second display module.

Hereinafter, the second display module 12 will be described in detail. FIG. 5-1 is a first composition structural schematic diagram of a second display module according to the fifth embodiment of the present application, and FIG. 5-2 is a second composition structural schematic diagram of the second display module according to the fifth embodiment of the present application. As shown in FIG. 5-1 and FIG. 5-2, the display component 15 includes a beam splitting unit 151 and a display unit 152, the collimating component 14 includes a second collimating unit 141, a first collimating unit 142 and a polarization splitting unit 143, and the optical conduction component 13 includes a waveguide unit 131 and a reflecting unit 132. Therein, the display component 15 shown in FIG. 5-2 further includes a light emitting unit 150. The collimating component 14 processes the first light beam projected and outputted in the beam mode, to convert the first light beam into a second light beam and output the second light beam to the optical conduction component.

Specifically, the collimating component 14 includes a first collimating unit 142 and a second collimating unit 141 disposed opposite to each other, as well as a polarization splitting unit 143 disposed between the first collimating unit 142 and the second collimating unit 141. The first light beam output from the display component is firstly reflected to the first collimating unit 142 via the polarization splitting unit 143, and then, after being collimated by the first collimating unit 142 and the second collimating unit 141, is emitted as the second light beam via the polarization splitting unit 143.

Here, the first collimating unit 142 and the second collimating unit 141 may be a single lens or a lens group according to design requirement.

The optical conduction component 13 is used for conducting the second light beam in the material which the optical conduction component is made of, and finally outputting the second light beam to a viewer. The optical conduction component 13 includes a waveguide unit 131 and a reflecting unit 132. The second light beam can be controlled by setting a position and an angle of the reflecting unit 132, to be guided to emit at the specific position. In a first circumstance, the collimating component 14 and the display component 15 are located on a first side with respect to a plane where the waveguide unit 131 is located; when the reflecting unit 132 as shown in FIG. 5-1 and FIG. 5-2 is set, the second light beam can be emitted to a second side with respect to the plane where the waveguide unit 131 is located. The first side and the second side are opposite sides with respect to the plane where the waveguide unit 131 is located.

Specifically, when the second display module is, for example, applied in a smart watch, the above-described configuration example can be used, such that the second light beam is emitted to the second side. That is, the second light beam is emitted to eyes of a user wearing and viewing such a wrist-mounted electronic apparatus. To further describe in detail, an emission direction of the second display module may be configured according to requirement of viewing. For example, rotation of the reflecting unit 132 may be controlled, so as to control the emission direction of the reflecting unit 132, and to implement switch of bidirectional display of the second display module. In an embodiment of the present application, the reflecting unit 132 may be a single prism or a prism group according to design requirement.

In an embodiment of the present application, the first display module 11 has a first display output region, and as described above, the first display module 11 is a first display screen. Thus, a physical size of the first display screen is consistent with a size of the first display output region, and a size of the first display output region is consistent with a size of the first protection region 1101.

The second display module 12 has a second display output region, and the second display output region is a specific region of the reflecting unit which is disposed on the excess portion. In general, a physical size of the reflecting unit 132 seen by a viewer (a user) is larger than or equal to a size of the second display output region, and a size of the display unit 152 in the second display module 12 is smaller than a size of the second display output region. It should be noted that, FIG. 5-1 and FIG. 5-2 are only to help those skilled in the art to understand the technical solutions of the present application, rather than states of the electronic apparatus provided by the embodiment of the present application in use. For example, the electronic apparatus in use is fixed on a support body, and when the support body is a wrist, the user raises his or her arm to place the electronic apparatus in front of his or her eyes. It is seen that the user can view information provided by the electronic apparatus in use at a front angle.

When the electronic apparatus has a first distance value from the viewer of the electronic apparatus, a size of display content on the first display screen as perceived by the eyes of the viewer is consistent with the first display output region. When the electronic apparatus has a first distance value from the viewer of the electronic apparatus, a size of the display content on the second display module 12 as perceived by the eyes of the viewer is larger than a size of the second display output region. For example, with reference to FIG. 5-3, a light spot 200 in the second protection region 1102 may be a display output effect when the second display output region of the second display module outputs the display content, and the light spot 200 is a light spot formed by the second light beam on the second protection region 1102. Further, when the viewer (the user) gets close to the electronic apparatus and when the eyes of the viewer (the user) has a first distance value from the electronic apparatus, the second light beam is incident to the eyes of the viewer (the user) which satisfy the first distance value from the electronic apparatus, so that the viewer perceives an amplified display content-2 formed after a display content-1 displayed on a display unit of the second display module is processed with the collimating component (that is, the display content-1 and the display content-2 are consistent in content, and a display effect of the display content-2 is an amplification effect of the display content-1). A size of the display content (the display content-2) displayed on the second display module as perceived by the viewer is larger than a size of the second display output region; and the display content (the display content-2) of the second display module as perceived by the viewer is felt like being at a greater distance (i.e., farther than the distance of the light spot 200 with respect to the eyes of the viewer) from the eyes of the viewer (himself or herself). As shown in FIG. 5-4, the eyes of the viewer get close to the light spot 200 of the second protection region 1102, and the light spot 200 (the second light beam) is incident to the eyes of the viewer, so that the viewer can see a more enriched display content compared to the display content output by the first display output region of the first display module, a size/dimension of the display content of the second display module as perceived by the user is far larger than a physical size/dimension of the display unit 152, and a size/dimension of the display content of the second display module as perceived by the user is far larger than the second display output region of the second display module. It can be seen from FIG. 5-4 that the display content of the second display module as perceived by the user is felt by the user to be at a certain distance behind the light spot 200. Here, the light spot 200 is a circle (see FIG. 5-3) or a rectangle (see FIG. 5-4) or a square.

When the user uses the electronic apparatus provided by the embodiment of the present application, the electronic apparatus firstly detects whether the electronic apparatus has a first distance value from the viewer, to obtain a detection result; when the detection result indicates that the electronic apparatus has a first distance value from the viewer, the second display module 12 is enabled, and associated data content is displayed through the second display module 12. In other words, the functional main body section of the electronic apparatus includes a first sensor, which is disposed in the frame body. The first sensor is used for sensing a distance value from the viewer to an outer surface of the protective layer of the electronic apparatus. When a distance value sensed by the first sensor satisfies the first distance value, the second display module 12 is enabled.

Sixth Embodiment

This embodiment of the present application provides an electronic apparatus, the electronic apparatus comprising a frame body, a fixing device and a functional main body section. The fixing device is connected to the frame body. The fixing device is used for fixing the electronic apparatus onto a support body. The frame body and the fixing device form a ring-like space when the electronic apparatus is fixed onto the support body by the fixing device. The functional main body section at least includes: a display device having a low power consumption mode and a high power consumption mode, a first battery, a second battery and a control circuit. The display device is disposed in the frame body, and is used for displaying and outputting display content. The first battery is disposed in the frame body or is disposed in the fixing device. The second battery is disposed in the frame body or is disposed in the fixing device. The control circuit is disposed in the frame body or is disposed in the fixing device. The control circuit is used for controlling the first battery to supply power for the display device when the display device is in the low power consumption mode, and controlling the second battery to supply power for the display device when the display device is in the high power consumption mode.

In an embodiment of the present application, the electronic apparatus is a wearable electronic apparatus. As a more preferable embodiment, the electronic apparatus may be a smart watch. As another more preferable embodiment, the electronic apparatus may also be a smart ring. When the electronic apparatus is a smart watch, the support body may either be a user's wrist, or be other part of the user's body; of course, the support body may also be any object other than the user's body part; for example, it may be a prosthetic arm, etc., and may also be a hand lever on a bus or a subway train. When the electronic apparatus is a smart ring, and correspondingly, the support body may be a finger.

The electronic apparatus has a first cross section. The first cross section is a ring formed by sectioning the electronic apparatus in a direction perpendicular to the support body with the support body as a reference object, when the electronic apparatus is fixed onto the support body by the fixing device. The support body is able to get through the ring. The ring is unlikely to be a standard circle; when the smart watch is worn on a wrist, the human wrist itself is not a standard cylinder; when the smart watch is worn on a finger, the finger is not a standard cylinder, either; thus, the ring formed by the electronic apparatus is not a standard circle, either.

In an embodiment of the present application, in terms of a battery capacity, a battery capacity of the first battery is less than a battery capacity of the second battery. Preferably, in order to ensure a small size and a light weight of the electronic apparatus, the first battery may be a button battery, and the second battery may be a rechargeable battery. Or, the first battery may be a solar battery. The solar battery indicates a battery that directly converts light energy into electrical energy through a photoelectric effect or a photochemical effect.

Figures 1, 6:
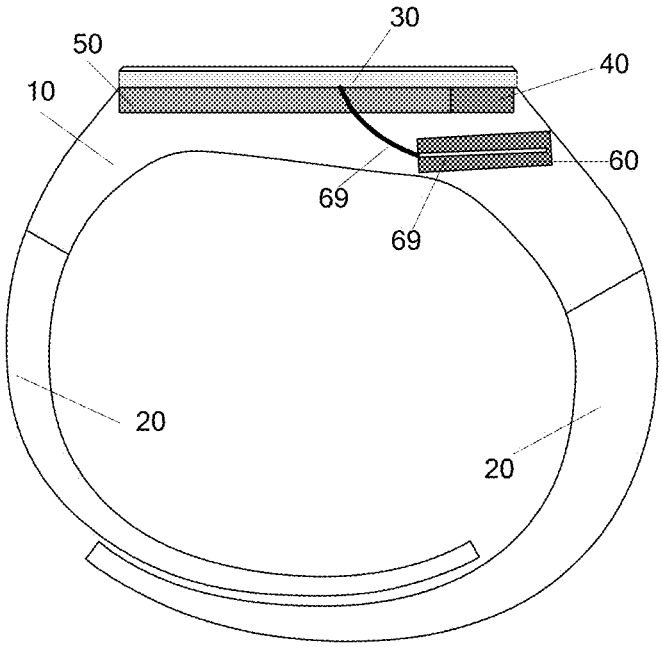
Figures 2, 6:
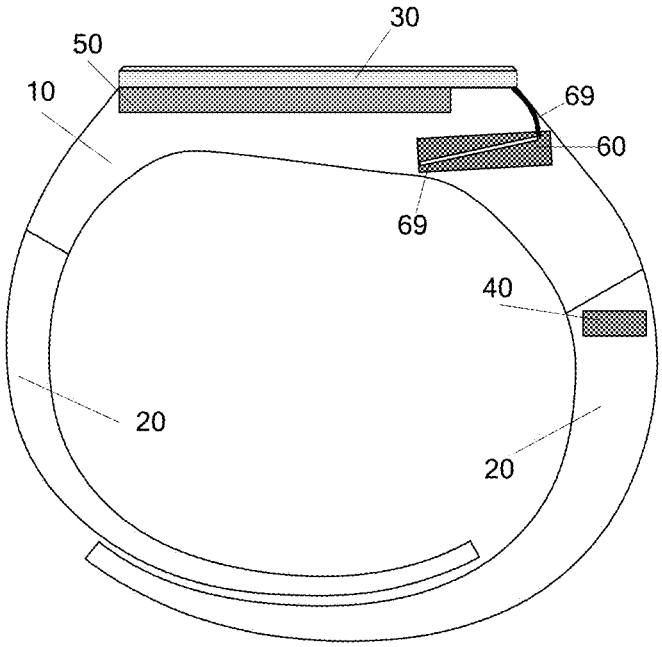
Figures 3, 6:
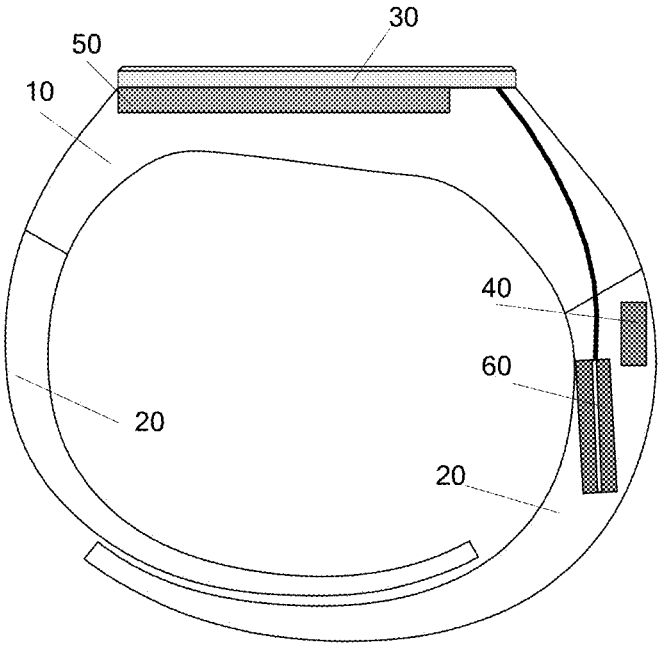
Figures 4, 6:
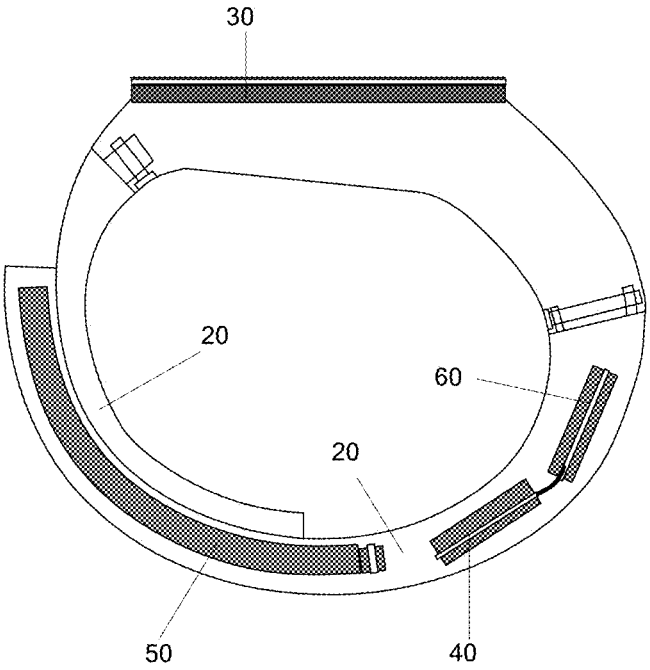
Figures 5, 6:
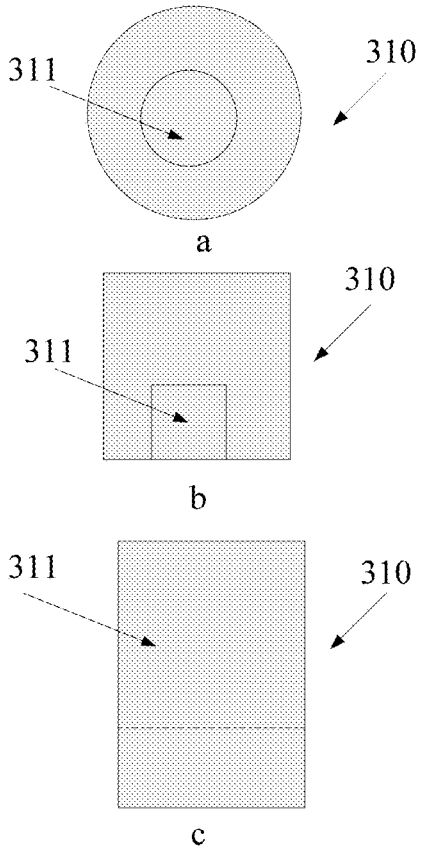
Figure 6:
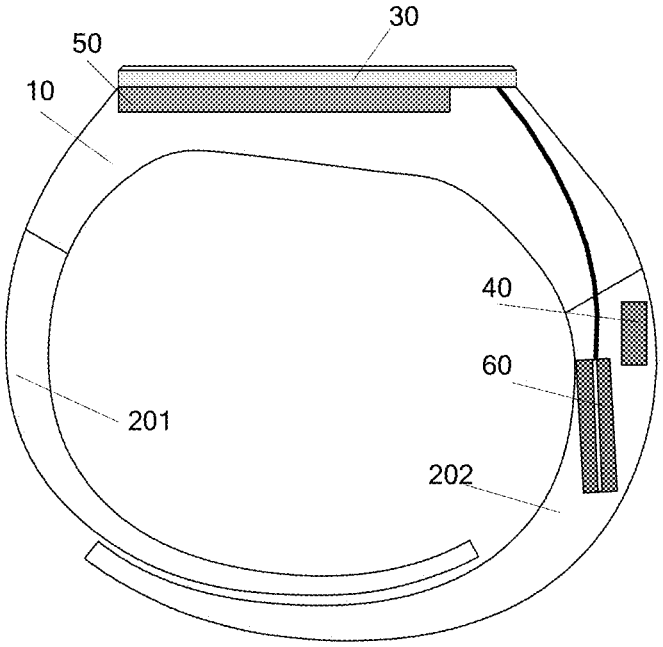

In an embodiment of the present application, when the electronic apparatus is a smart watch, the above fixing device may be understood as a watchband, and the above fame body may be understood as a dial plate. It should be noted that, the frame body in the embodiment of the present application may further include part of the dial plate or the whole dial plate, which at least can be seen from embodiments as shown in FIG. 6-1 to FIG. 6-4 described as follows.

When the first battery and/or the second battery are/is disposed in the fixing device, the first battery and the second battery can be batteries in a form of a sheet or a strip. As a preferable embodiment of the present application, the first battery and/or the second battery may be flexible batteries, and the second battery changes with a shape of the fixing device.

When the first battery and/or the second battery are/is flexible batteries, the fixing device includes a first surface made of a first material, a second surface made of a second material, and a flexible battery located between the first surface and the second surface. The first material and the second material may be the same material, for example, leather; of course, the first material and the second material may be different materials, for example, a combination of leather and canvas.

In an embodiment of the present application, the control circuit is further used for controlling the electronic apparatus to be in a first operating mode which corresponds to a low power consumption mode of the display device, when the display device is in the low power consumption mode; and controlling the electronic apparatus to be in a second operating mode which corresponds to a high power consumption mode of the display device, when the display device is in the high power consumption mode.

In general, at present, a part of an intelligent electronic apparatus that consumes the most power should be the display device of the electronic apparatus, and thus, the power consumption of the display device substantially decides the power consumption of the electronic apparatus. In other words, when the display device is in a low power consumption mode, the electronic apparatus is in a first operating mode, of which the power consumption is relatively low; and when the display device is in a high power consumption mode, the electronic apparatus is in a second operating mode, of which the power consumption is relatively high. The power consumption of such an electronic apparatus and the power consumption of the display device are positively correlated. That is, the power consumption of the first operating mode of the electronic apparatus is less than the power consumption of the second operating mode of the electronic apparatus.

Of course, there are other power-consuming components in the electronic apparatus such as a control circuit, so the positive correlation between the power consumption of the electronic apparatus and the power consumption of the display device are not certain, and there may also be an inverse correlation between the power consumption of the electronic apparatus and the power consumption of the display device. Such an inverse correlation indicates that, when the display device is in the low power consumption mode, the electronic apparatus is in the first operating mode, and when the display device is the high power consumption mode, the electronic apparatus is in the second operating mode; however, the power consumption of the electronic apparatus in the first operating mode is larger than the power consumption of the electronic apparatus in the second operating mode.

In an embodiment of the present application, the fixing device is a connecting band which is made of a flexible material. The connecting band is movably connected to the frame body. Or, the fixing device includes a connecting band which is made of a flexible material and a locking mechanism. The connecting band is movably connected to the frame body, and the connecting band is fixedly connected to the locking mechanism.

The technical solution provided by the sixth embodiment of the present application is applicable to the electronic apparatus having a dual-mode display device by arranging a dual-battery. The dual-mode just is the low power consumption mode and the high power consumption mode, and the dual-battery just is the first battery and the second battery. Specifically, the display device is powered by the first battery when the display device is in the low power consumption mode, and the display device is powered by the second battery when the display device is in the high power consumption mode. It is seen that the electronic apparatus is powered by different batteries specific to different power consumption modes. Accordingly, standby time of the electronic apparatus having the dual-mode display device is avoided, and user experience is improved.

Based on the above-described embodiments, this embodiment of the present application provides an electronic apparatus. FIG. 6-1 is a first cross-sectional schematic diagram of the electronic apparatus according to the sixth embodiment of the present application. As shown in FIG. 6-1, the electronic apparatus comprises a frame body 10, a fixing device 20 and a functional main body section.

The fixing device 20 is connected to the frame body 10, and the fixing device 20 is used for fixing the electronic apparatus onto a support body. The frame body 10 and the fixing device 20 form a ring-like space when the electronic apparatus is fixed onto the support body by the fixing device 20.

The functional main body section at least includes a display device 30 having a low power consumption mode and a high power consumption mode, a first battery 40, a second battery 50 and a control circuit 60.

The display device 30, disposed in the frame body, is used for displaying and outputting display content. The first battery 40, the second battery 50 and the control circuit 60 are all disposed in the frame body. The control circuit 60 is electrically connected to the display device 30 through a connecting line 69. The first battery 40 is electrically connected to the display device 30. The second battery 50 is electrically connected to the display device 30. The control circuit 60 is used for controlling the first battery 40 to supply power for the display device 30 when the display device 30 is in the low power consumption mode; and controlling the second battery 50 to supply power for the display device 30 when the display device 30 is in the high power consumption mode.

In an embodiment of the present application, as shown in FIG. 6-2, the first battery 40 is also be disposed in the fixing device 20, and the first battery 40 is electrically connected to the display device 30; while the second battery 50 and the control circuit 60 are disposed in the frame body 10, the second battery 50 is electrically connected to the display device 30, and the control circuit 60 is electrically connected to the display device 30 through the connecting line 69.

In an embodiment of the present application, as shown in FIG. 6-3, the first battery 40 and the control circuit 60 is also be disposed in the fixing device 20, the first battery 40 is electrically connected to the display device 30, and the control circuit 60 is electrically connected to the display device 30 through the connecting line 69; while the second battery 50 is disposed in the frame body 10, and the second battery 50 is electrically connected to the display device 30.

In an embodiment of the present application, as shown in FIG. 6-4, the first battery 40, the control circuit 60 and the second battery 50 are all disposed in the fixing device 20. The first battery 40 is electrically connected to the display device 30, the control circuit 60 is electrically connected to the display device 30 through the connecting line 69, and the second battery 50 is electrically connected to the display device 30.

In the embodiments as shown in FIG. 6-1 to FIG. 6-4 above, in order to make FIG. 6-1 to FIG. 6-4 clear and simple, the connecting line 69 that electrically connects the first battery 40 and the display device 30 is omitted, and the connecting line 69 that electrically connects the second battery 50 and the display device 30 is also omitted. The above FIG. 6-1 to FIG. 6-4 only show several possible forms of combination in which the first battery 40, the control circuit 60 and the second battery 50 are respectively disposed in the fixing device 20 or disposed in the frame body 10, rather than all possible forms of combination. Those skilled in the art can, according to the technical solutions shown from FIG. 6-1 to FIG. 6-4, dispose the first battery 40, the control circuit 60 and the second battery 50 respectively in the fixing device 20 or in the frame body 10, so other possible forms of combination will not be described here.

The display device 30 in the embodiments shown in the above FIG. 6-1 to FIG. 6-4 only includes one display module. The display module may be a display screen. FIG. 6-5 is a top-view schematic diagram of the display device in FIG. 6-1. As shown in FIG. 6-5, the display region of the display screen either is a circle as shown in subfigure a in FIG. 6-5, a square as shown in subfigure b in FIG. 6-5, or a rectangle as shown in subfigure c in FIG. 6-5. When a low power consumption display mode of the display device is started, the control circuit controls to lighten a partial display region of the display screen. When a high power consumption display mode of the display device is started, the control circuit controls to lighten the whole display region of the display screen. For example, in the high power consumption display mode, the control circuit controls to lighten the whole display region 310 of the display screen; in the low power consumption display mode, the control circuit controls to lighten a partial display region 311 of the display screen. A position where the partial display region is disposed is as shown in subfigure a in FIG. 6-5. The partial display region is disposed in a middle portion of the whole display region. Of course, as shown in subfigure b in FIG. 6-5, the partial display region is also disposed in the middle of a lower portion of the whole display region. Of course, as shown in subfigure c in FIG. 6-5, the partial display region is also disposed in the lower portion of the whole display region. Those skilled in the art may also design the position of the partial display region in the whole display region voluntarily as required, which will not be described here.

The display device 30 in the above-described embodiments shown in FIG. 6-1 to FIG. 6-4 only includes one display module. The display module may be a display screen, in which N adjacent pixels constitute a unit pixel. For example, every 4 adjacent pixels may constitute a pixel unit, and every two adjacent pixels may also constitute a pixel unit, and so on. When the low power consumption display mode of the display device is started, the control circuit controls to lighten partial pixels in each pixel unit; when the high power consumption display mode of the display device is started, the control circuit controls to lighten all pixels in each pixel unit. With 4 adjacent pixels constituting a pixel unit as an example, when the low power consumption display mode of the display device is started, the control circuit controls to lighten 1 or 2 or 3 pixels in each pixel unit; when the high power consumption display mode of the display device is started, the control circuit controls to lighten all the 4 pixels in each pixel unit. In the present embodiment, the high power consumption display mode and the low power consumption display mode are implemented by controlling to lighten all pixels or partial pixels in each pixel unit; when all pixels in each pixel unit are lightened, the power consumption is certainly higher, which is naturally called the high power consumption mode, and at this time, the resolution of the display device is higher; and when partial pixels in each pixel unit are lightened, the power consumption is certainly lower, which is naturally called the low power consumption mode, and at this time, the resolution of the display device is lower.

In one embodiment of the present application, the electronic apparatus, as shown in FIG. 6-6, comprise two fixing devices which are a first fixing device 201 and a second fixing device 202. A first end of the first fixing device 201 is movably connected to a first end of the frame body 10. A first end of the second fixing device 202 is movably connected to a second end of the frame body 10, and a second end of the first fixing device 201 coordinates with a second end of the second fixing device 202 to fix the electronic apparatus onto the support body. In a specific implementation process, those skilled in the art can implement the coordination between the second end of the first fixing device 201 and the second end of the second fixing device 202 by a snap member, or an adhesive member or the like. Those skilled in the art can further implement a movable connection between the first end of the first fixing device 201 and the first end of the frame body 10, as well as a movable connection between the first end of the second fixing device 202 and the second end of the frame body 10 by a rotating shaft, which will not be described here.

In one embodiment of the present application, as shown in FIG. 1-2, the electronic apparatus further comprise only one fixing device which is a fixing device 203. A first end 231 of the fixing device 203 is movably connected to a first end 1001 of a frame body 10. A second end 232 of the fixing device 203 is fixed together with a second end 1002 of the frame body 10 by a snap member 1003.

As can be seen from the embodiments shown in FIG. 6-1 to FIG. 6-4 of the present application, the first battery 40, the control circuit 60 and the second battery 50 are respectively disposed in the fixing device 20 or disposed in the frame body 10; for different disposed positions, relatively speaking, it is shape and volume of the fixing device 20 and the frame body 10 that are changed. For example, when the first battery 40, the control circuit 60 and the second battery 50 are all disposed in the fixing device 20, a volume of the frame body 10 seems relatively small. Specifically, when a size of orthographic projection of the frame body 10 is fixed, and only the display device 30 is disposed in the frame body 10, a thickness of the frame body 10 will be relatively thin. As another example, when the first battery 40, the control circuit 60 and the second battery 50 are all disposed in the frame body 10, the volume of the frame body 10 seems relative large.

Seventh Embodiment

Figures 1, 7:
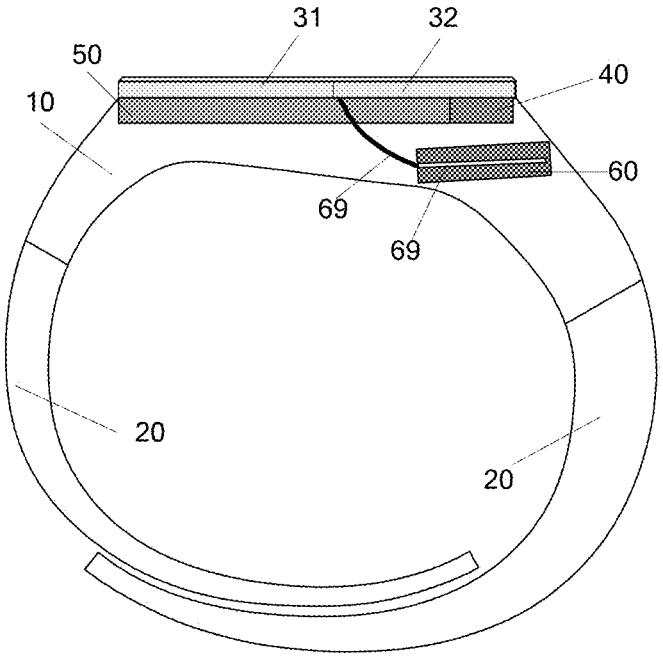
Figures 2, 7:
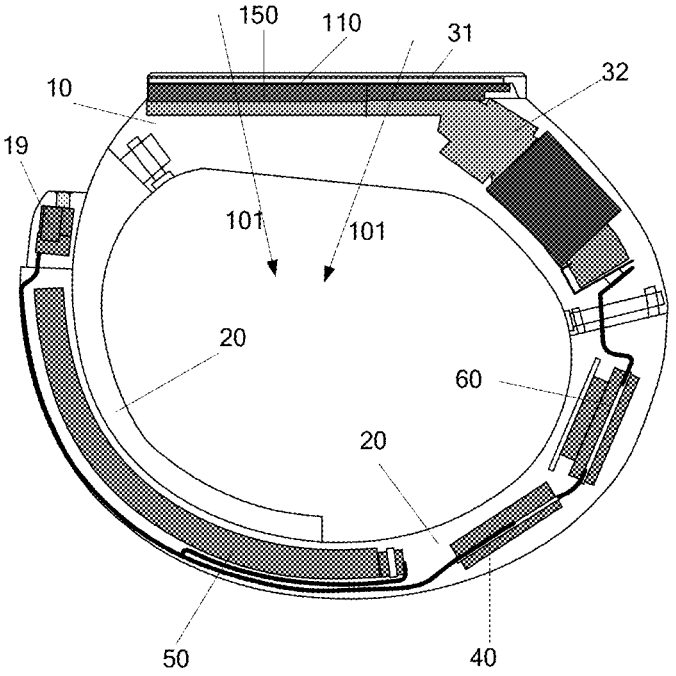
Figures 3, 7:
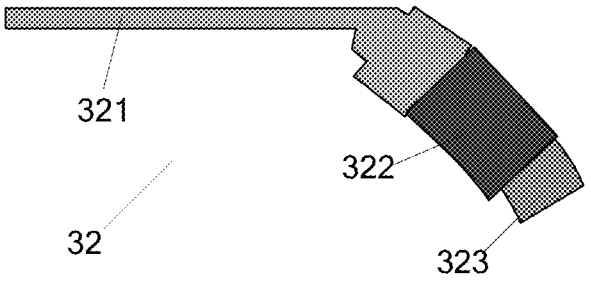
Figures 4, 7:
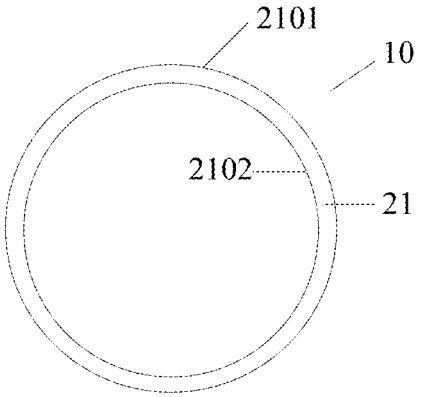
Figures 5, 7:
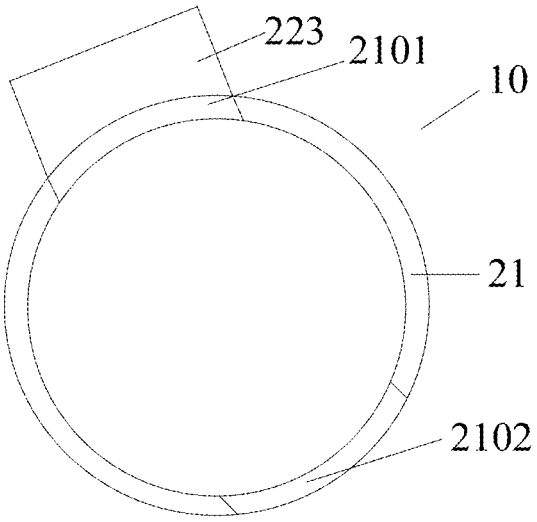
Figures 6, 7:
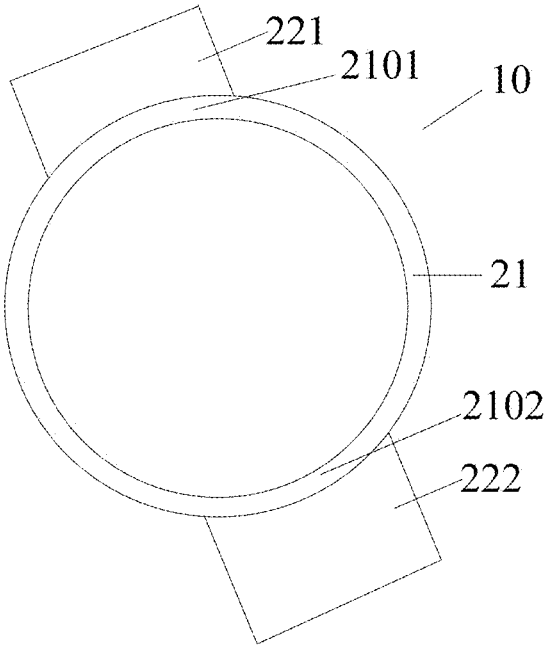

Based on the above sixth embodiment of the present application, this embodiment of the present application provides an electronic apparatus. FIG. 7-1 is a first composition structural schematic diagram of the electronic apparatus according to the seventh embodiment of the present application. As shown in FIG. 7-1, the electronic apparatus comprises a frame body 10, a fixing device 20 and a functional main body section.

The fixing device 20 is connected to the frame body 10, and the fixing device 20 is used for fixing the electronic apparatus onto a support body. The frame body 10 and the fixing device 20 form a ring-like space when the electronic apparatus is fixed onto the support body by the fixing device.

The functional main body section at least includes: a display device having a low power consumption mode and a high power consumption mode, a first battery 40, a second battery 50 and a control circuit 60.

The display device includes a first display module 31 and a second display module 32. The first display module 31 and the second display module 32 are disposed in the frame body 10. Viewed from a display region of the display device, the first display module 31 and the second display module 32 are disposed in parallel.

The electronic apparatus has a first cross section. The first cross section is a ring formed by sectioning the electronic apparatus in a direction perpendicular to the support body with the support body as a reference object, when the electronic apparatus is fixed onto the support body by the fixing device.

The first battery 40, the second battery 50 and the control circuit 60 are all disposed in the frame body. The control circuit 60 is electrically connected to the first display module 31 and the second display module 32 in the display device through a connecting line 69, the first battery 40 is electrically connected to the first display module 31 and/or the second display module 32 in the display device, and the second battery 50 is electrically connected to the second display module 32 and/or the first display module 31 in the display device.

The control circuit 60 is used for controlling the first battery 40 to supply power for the first display module 31 and/or the second display module 32 in the display device when the display device 30 is in the low power consumption mode, and controlling the second battery 50 to supply power for the second display module 32 in the display device when the display device 30 is in the high power consumption mode.

In an embodiment of the present application, a power consumption of the first display module 31 is lower than a power consumption of the second display module 32; when the display device is in the low power consumption state, the first display module is in an operating state; when the display device is in the high power consumption state, the second display module is in an operating state.

Specifically, the first display module is a display screen of low power consumption, and the second display module is a display screen of high power consumption. The first display module may be an E-ink display screen, a Light Emitting Diode (LED) display screen, or a Liquid Crystal Display (LCD); and the second display module may be an LED display screen, an LCD or an optical projection system. For example: in terms of power consumption, the E-ink display screen has a power consumption lower than that of the Light Emitting Diode (LED) display screen, and therefore, the first display module may be an E-ink display screen, and the second display module may be an ordinary LED display screen; when the E-ink display screen operates, the display device is in the low power consumption mode, and when the LED display screen operates, the display device is in the high power consumption mode. As another example, the E-ink display screen has a power consumption lower than that of the LCD, and therefore, the first display module may be an E-ink display screen, and the second display module may be an ordinary LCD; when the E-ink display screen operates, the display device is in the low power consumption mode, and when the LCD display screen operates, the display device is in the high power consumption mode. As still another example, the LED display screen has a power consumption lower than that of the optical projection system, and therefore, the first display module may be an LED display screen, and the second display module may be an optical projection system; when the LED display screen operates, the display device is in the low power consumption mode, and when the optical projection system operates, the display device is in the high power consumption mode.

It should be noted that, corresponding to the above-described two display modules, the control circuit in the embodiment of the present application may include two sets of control circuit. A first set of control circuit corresponds to the low power consumption mode, while a second set of control circuit corresponds to the high power consumption mode. Specifically, the first set of control circuit may be a control circuit including a Micro Control Unit (MCU), and the second set of control circuit may be a control circuit including a Central Processing Unit (CPU). The CPU has power consumption higher than that of the MCU, but the CPU has a function stronger than that of the MCU. Therefore, when the first display module of low power consumption operates, the power consumption of the first set of control circuit is relatively low, and then the power consumption of the first operating mode of the electronic apparatus is lower than that of the second operating mode.

In an embodiment of the present application, the fixing device may be a connecting band, which is made of a flexible material. The connecting band is movably connected to the frame body. Or, the fixing device includes a connecting band which is made of a flexible material and a locking mechanism. The connecting band is movably connected to the frame body, and the connecting band is fixedly connected to the locking mechanism.

In an embodiment of the present application, the connecting band has an accommodating space; the control circuit is disposed in the accommodating space in accordance with a shape of the accommodating space; the control circuit is led out of the accommodating space of the connecting band through a flexible connecting line and is led into the frame body, to be electrically connected to the first display module and the second display module, respectively.

In an embodiment of the present application, the connecting band has an accommodating space; the first battery and the second battery are sequentially disposed in the accommodating space in parallel in accordance with a shape of the accommodating space; the first battery is electrically connected to a first end of the control circuit through the flexible connecting line; the second battery is electrically connected to the first end of the control circuit through the flexible connecting line. A second end of the control circuit is led out of the accommodating space of the connecting band through the flexible connecting line and is led into the frame body, to be electrically connected to the first display module and the second display module, respectively.

Based on the above-described embodiment as shown in FIG. 7-1, an embodiment of the present application provides an electronic apparatus, and the second display module in the electronic apparatus is an optical projection system. FIG. 7-2 is a second composition structural schematic diagram of the electronic apparatus according to the seventh embodiment of the present application. As shown in FIG. 7-2, the electronic apparatus comprises a frame body 10, a fixing device 20 and a functional main body section.

The fixing device 20 is connected to the frame body 10. The fixing device 20 is used for fixing the electronic apparatus onto a support body. The frame body 10 and the fixing device 20 form a ring-like space, when the electronic apparatus is fixed onto the support body by the fixing device.

The functional main body section at least includes: a display device having a low power consumption mode and a high power consumption mode, a first battery 40, a second battery 50 and a control circuit 60.

The electronic apparatus has a first cross section. The first cross section is a ring formed by sectioning the electronic apparatus in a direction perpendicular to the support body with the support body as a reference object, when the electronic apparatus is fixed onto the support body by the fixing device.

The first battery 40, the second battery 50 and the control circuit 60 are all disposed in the frame body 20. The control circuit 60 is electrically connected to the first display module 31 and the second display module 32 in the display device. The first battery 40 is electrically connected to the first display module 31 and/or the second display module 32 in the display device. The second battery 50 is electrically connected to the second display module 32 in the display device.

The control circuit 60 is used for controlling the first battery 40 to supply power for the first display module 31 and/or the second display module 32 in the display device when the display device is in the low power consumption mode, and controlling the second battery 50 to supply power for the second display module 32 in the display device when the display device 30 is in the high power consumption mode.

The display device includes a first display module 31 and a second display module 32. The first display module 31 is disposed in the frame body 10. The second display module 32 is also disposed in the frame body 10. The first display module 31 and the second display module 32 are stacked in a first direction 101 (the direction shown by an arrow 101). The first direction is a direction from outside of the ring to inside of the ring and toward a center of the ring. The first display module may be an E-ink display screen, an LED screen, an LCD screen, or any other display screen. The first display screen 31 is used for displaying and outputting a first to-be-displayed content. A size of the first display screen is a first display output region of the first display module. The second display module 32 is an optical projection system. As shown in FIG. 7-3, the second display module 32 includes a first portion 321 and a second portion. The first portion 321 of the second display module is an optical conduction component, and the second portion of the second display module includes a display component 322 and a collimating component 323.

The display component 322 is used for displaying and outputting a second to-be-displayed content, to project a first light beam in a beam mode and output the first light beam to the collimating component 323. The collimating component 323 is used for processing the first light beam projected and outputted in the beam mode, to convert the first light beam into a second light beam and output the second light beam to the optical conduction component 321. The optical conduction component 321 is also called as an optical path conversion component. The optical conduction component is made of a transparent material. The optical conduction component 321 is used for conducting the second light beam in the material which the optical conduction component is made of. The optical conduction component includes a reflecting unit. The reflecting unit is disposed in a specific region of the excess portion. The reflecting unit is used for changing a conducting direction of the second light beam in the transparent material, to be projected in a second direction. The second direction is consistent with an output direction of the first to-be-displayed content of the first display screen of the first display module. The specific region provided with the reflecting unit in the optical conduction component is a second display output region of the second display module.

In an embodiment of the present application, the functional main body section further includes a sensing device for sensing operation information of an operator of the electronic apparatus. The sensing device is disposed in the frame body or in the fixing device.

The sensing device is connected to the control circuit, and the control circuit determines whether to start the high power consumption mode of the display device according to the operation information obtained by the sensing device. When it is determined to start the high power consumption mode of the display device according to the operation information obtained by the sensing device, the control circuit controls to enable the high power consumption mode of the display device, and in the meantime controls the second battery to supply power for the display device. When it is determined that it is not necessary to start the high power consumption mode of the display device according to the operation information obtained by the sensing device, the control circuit maintains the low power consumption mode of the display device, and in the meantime maintains the first battery to supply power for the display device.

In an embodiment of the present application, the functional main body section further includes a data interface 19, for transmitting data and/or transmitting power. The data interface is disposed in the fixing device. The data interface is connected to the battery module through the flexible connecting line; and/or the data interface is connected to the mainboard module through the flexible connecting line.

Here, the data interface 19 may be a Universal Serial Bus (USB) interface, which may be used for charging other electronic apparatuses, or may be used for transmitting data between electronic apparatuses.

In an embodiment of the present application, as a preferable embodiment, the electronic apparatus further comprises a protective layer 110, which is made of a transparent material. The protective layer 110 is disposed in the main frame body 10. A shape of the protective layer 110 is consistent with the first shape, and the protective layer occupies the whole region formed by the first shape. The protective layer 110, the first display module 31 and the first portion of the second display module 32 are stacked sequentially according to the first direction; and the protective layer is used for protecting the first display module and the first portion of the second display module.

The protective layer includes a first protection region and a second protection region. A first display output region of the first display module corresponds to the first protection region. A second display output region of the second display module corresponds to the second protection region. The first protection region is an orthographic projection region of the first display output region on the protective layer. The second protection region includes an orthographic projection region of the second display output region on the protective layer. The first protection region and the second protection region are disposed in parallel.

The electronic apparatus further comprises a support structure 150, which is made of a transparent material. The support structure 150 is disposed in the main frame body. The support structure 150 and the first display module 31 are disposed in parallel. The excess portion is a portion in the first portion of the second display module that exceeds the first display module. The support structure 150 is located between the protective layer 110 and the excess portion, and the support structure 150 is used for supporting the protective layer and the excess portion, in order to enhance strength of the protective layer 110 and the excess portion.

It should be noted that, the electronic apparatus may not include a support structure. When the support structure is not included, there is a hollow structure between the protective layer and the excess portion. Therefore, strength of the protective layer having no support structure is less than strength of the protective layer 110 having the support structure.

The frame body includes a main frame body. The main frame body is projected as a first shape on the support body, when the electronic apparatus is fixed onto the support body by the fixing device. Here, the first shape may be a circle, a square, and a rectangle.

Now with the first shape being a circle as an example, the frame body 10 provided by the embodiment of the present application is specifically illustrated. The frame body 10 includes a main frame body and a sub frame body. The sub frame body may or may not exist. That is to say, the frame body 10 may include only the main frame body, at which time all the functional main body sections are disposed in the main frame body. In other words, the above-described first display module 31 and the second display module 32 are both disposed in the main frame body, and the above-described fixing device may be understood as a watchband of a smart watch. Of course, the smart watch may either include one watchband, or include two watchbands. When the smart watch only includes one watchband, the watchband at least includes a portion of a watch buckle thereon, and correspondingly another portion of the watch buckle is disposed on the main frame body. When the smart watch includes two watchbands which are a first watchband and a second watchband, a portion of the watch buckle is disposed on the first watchband, and correspondingly another portion of the watch buckle is disposed on the second watchband.

As shown in FIG. 7-4, the frame body 10 only includes a main frame body 21, the main frame body 21 having a certain thickness, and thus includes two circles 2101 and 2102 as shown in FIG. 7-4. In one embodiment of the present application, the frame body may include one sub frame body, or may include two sub frame bodies. When the frame body includes one sub frame body, as shown in FIG. 7-5, the frame body 10 includes a main frame body 21 and a sub frame body 223. A first contact portion 2101 of the main frame body 21 is connected to one end of the sub frame body 223, and a second contact portion 2102 of the sub frame body 223 is connected to a fixing device. Of course, a number of the fixing device may be one or two, which may be with reference to the sixth embodiment and will not be described here.

When the frame body includes two sub frame bodies, as shown in FIG. 7-6, the frame body includes a main frame body 21, a first sub frame body 221 and the second sub frame body 222. A first end of the first sub frame body 221 is connected to a first contact portion 2101 of the main frame body 21, and a first end of the second sub frame body 221 is connected to a second contact portion 2102 of the main frame body 21. A fixing device is connected between a second end of the first sub frame body 221 and a second end of the second sub frame body 222. Of course, a number of the fixing device may be one or two, which may be with reference to the sixth embodiment and will not be described here.

In cases as shown in FIG. 7-5 and FIG. 7-6, the frame body includes at least one sub frame body besides a main frame body. At this time, the functional modules included in the functional main body section are respectively disposed in the main frame body and the sub frame body. In other words, the first display module 31 and the second display module 32 described above are disposed in the main frame body and the sub frame body. In this case, the sub frame body becomes a portion of the watchband of the smart watch shown in FIG. 7-4. When the frame body further includes a sub frame body, the sub frame body and the main frame body are formed integrally.

Eighth Embodiment

Figures 1, 8:
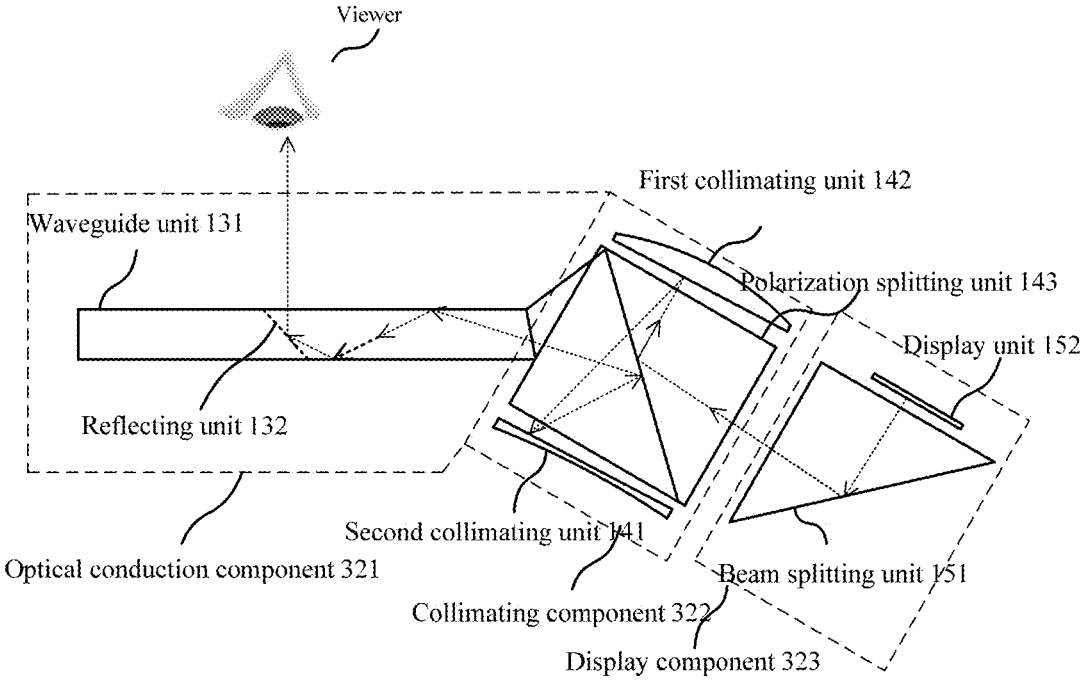
Figures 2, 8:
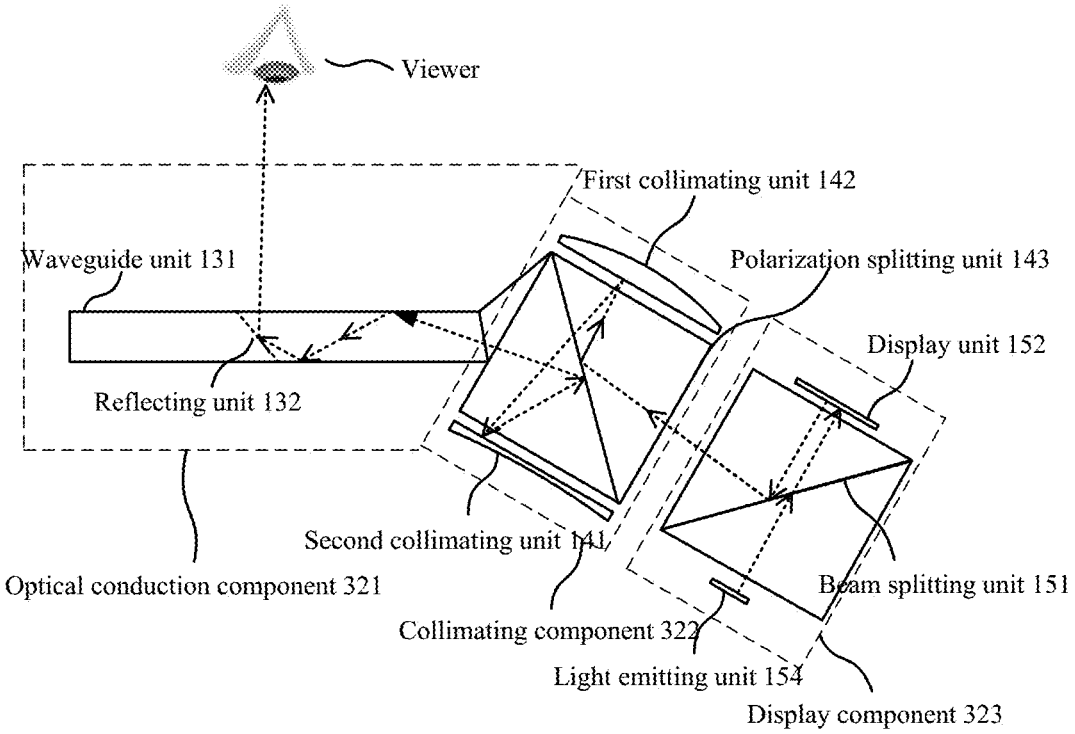

Based on the above the seventh embodiment, this embodiment of the present application further provides an optical projection system in the seventh embodiment. FIG. 8-1 is a first composition structural schematic diagram of a second display module according to the eighth embodiment of the present application. FIG. 8-2 is a second composition structural schematic diagram of the second display module according to the eighth embodiment of the present application. As shown in FIG. 8-1 and FIG. 8-2, the display component 323 includes a beam splitting unit 151 and a display unit 152, the collimating component 322 includes a second collimating unit 141, a first collimating unit 142 and a polarization splitting unit 143, and the optical conduction component 321 includes a waveguide unit 131 and a reflecting unit 132. The display component 323 shown in FIG. 8-2 further includes a light emitting unit 154. The collimating component 322 processes the first light beam projected and outputted in a beam mode, to convert the first light beam into a second light beam to output the second light beam to the optical conduction component.

Specifically, the collimating component 323 includes a first collimating unit 142 and a second collimating unit 141 disposed opposite to each other, as well as a polarization splitting unit 143 disposed between the first collimating unit 142 and the second collimating unit 141. The first light beam output from the display component is firstly reflected to the first collimating unit 142 via the polarization splitting unit 143, and then, after being collimated by the first collimating unit 142 and the second collimating unit 141, is emitted as the second light beam via the polarization splitting unit 143.

Here, the first collimating unit 142 and the second collimating unit 141 may be a single lens or a lens group which is designed based on requirement.

The optical conduction module 321 is used for conducting the second light beam in the material which the optical conduction component is made of, and finally outputting the second light beam to a viewer. The optical conduction component 321 includes a waveguide unit 131 and a reflecting unit 132. The second light beam can be controlled by setting a position and an angle of the reflecting unit 132, to be guided to emit at the specific position. In a first circumstance, the collimating component 322 and the display component 323 are located on a first side with respect to a plane where the waveguide unit 131 is located. When the reflecting unit 132 as shown in FIG. 8-1 and FIG. 8-2 is set, the second light beam can be emitted to a second side with respect to the plane where the waveguide unit 131 is located. The first side and the second side are opposite sides with respect to the plane where the waveguide unit 131 is located.

Specifically, when the second display module is, for example, applied to a smart watch, the above-described configuration example can be used, such that the second light beam is emitted to the second side. That is, the second light beam is emitted to eyes of a user wearing and viewing such a wrist-mounted electronic apparatus. To further describe in detail, an emission direction of the second display module may be configured according to needs of viewing. For example, rotation of the reflecting unit 132 may be controlled, so as to control the emission direction of the reflecting unit 132, and to implement a switch of bidirectional display of the second display module. In an embodiment of the present application, the reflecting unit 132 may be a single prism or a prism group which is designed based on requirement.

In an embodiment of the present application, the first display module 31 has a first display output region, and as described above, the first display module 31 is a first display screen. Thus, a physical size of the first display screen is consistent with a size of the first display output region, and a size of the first display output region is consistent with a size of the first protection region 1101.

The second display module 32 has a second display output region. The second display output region is a specific region of the reflecting unit which is disposed on the excess portion. In general, a physical size of the reflecting unit 132 seen by a viewer (a user) is larger than or equal to a size of the second display output region, and a size of the display unit 152 in the second display module 32 is smaller than a size of the second display output region. It should be noted that, FIG. 8-1 and FIG. 8-2 are only to help those skilled in the art to understand the technical solutions of the present application, but not states of the electronic apparatus provided by the embodiment of the present application in use. For example, the electronic apparatus in use is fixed on a support body, and when the support body is a wrist, the user raises his or her arm to place the electronic apparatus in front of his or her eyes. It is seen that the user can view information provided by the electronic apparatus in use at a front angle.

When the electronic apparatus has a first distance value from the viewer of the electronic apparatus, a size of display content on the first display screen as perceived by the eyes of the viewer is consistent with the first display output region. When the electronic apparatus has a first distance value from the viewer of the electronic apparatus, a size of the display content displayed on the second display module 32 as perceived by the eyes of the viewer is larger than a size of the second display output region. For example, with reference to FIG. 5-3, a light spot 200 in the second protection region 1102 may be a display output effect when the second display output region of the second display module outputs the display content, and the light spot 200 is a light spot formed by the second light beam on the second protection region 1102. Further, when the viewer (the user) gets close to the electronic apparatus and when the eyes of the viewer (the user) has a first distance value from the electronic apparatus, the second light beam is incident to the eyes of the viewer (the user) which satisfy the first distance value from the electronic apparatus, so that the viewer perceives an amplified display content-2 formed after a display content-1 displayed on a display unit of the second display module is processed with the collimating component (that is, the display content-1 and the display content-2 are consistent in content, and a display effect of the display content-2 is an amplification effect of the display content-1). A size of the display content (e.g. the display content-2) displayed on the second display module as perceived by the viewer is larger than a size of the second display output region. The display content (e.g., the display content-2) of the second display module as perceived by the viewer is felt like being at a greater distance (i.e., farther than the distance of the light spot 200 with respect to the eyes of the viewer) from the eyes of the viewer (himself or herself). As shown in FIG. 5-4, the eyes of the viewer get close to the light spot 200 of the second protection region 1102, and the light spot 200 (the second light beam) is incident to the eyes of the viewer, so that the viewer can see a more enriched display content compared to the display content output by the first display output region of the first display module. A size/dimension of the display content of the second display module as perceived by the user is far larger than a physical size/dimension of the display unit 152. A size/dimension of the display content of the second display module as perceived by the user is far larger than the second display output region of the second display module. It can be seen from FIG. 5-4 that the display content of the second display module as perceived by the user is felt by the user to be at a certain distance behind the light spot 200. Here, the light spot 200 is a circle (see FIG. 5-3) or a rectangle (see FIG. 5-4) or a square.

When the user uses the electronic apparatus provided by the embodiment of the present application, the electronic apparatus firstly detects whether the electronic apparatus has a first distance value from the viewer, to obtain a detection result. When the detection result indicates that the electronic apparatus has a first distance value from the viewer, the second display module 32 is enabled, and associated data content is displayed through the second display module 32. In other words, the functional main body section of the electronic apparatus includes a first sensor, which is disposed in the frame body. The first sensor is used for sensing a distance value from the viewer to an outer surface of the protective layer of the electronic apparatus. When a distance value sensed by the first sensor satisfies the first distance value, the second display module 32 is enabled.

Of course, in another embodiment of the present application, the functional main body of the respective electronic apparatuses provided above may further include a second sensor, which is disposed in a frame body. The second sensor is used for sensing a relative position between the electronic apparatus and a viewer wearing the electronic apparatus. When the relative position between the electronic apparatus and the viewer wearing the electronic apparatus sensed by the second sensor satisfies a first relative region, it indicates that the electronic apparatus is located in a region on a side of the viewer. When the relative position between the electronic apparatus and the viewer wearing the electronic apparatus sensed by the second sensor satisfies a second relative region, it indicates that the electronic apparatus is located in a region in front of the body of the viewer. When the relative position between the electronic apparatus and the viewer wearing the electronic apparatus sensed by the second sensor satisfies a third relative region, it indicates that the electronic apparatus is located in a region in front of the head of the viewer. During actual application process of the electronic apparatus provided by the embodiment of the present application, when the relative position between the electronic apparatus and the viewer wearing the electronic apparatus sensed by the second sensor satisfies the first relative region, the electronic apparatus controls the first display module and the second display module to be in a low power consumption state (an off state or a standby state); when the relative position between the electronic apparatus and the viewer wearing the electronic apparatus sensed by the second sensor satisfies the second relative region, the electronic apparatus controls the first display module to be in an operating state and the second display module to be maintained in the low power consumption state; when the relative position between the electronic apparatus and the viewer wearing the electronic apparatus sensed by the second sensor satisfies the third relative region, the electronic apparatus at least controls the second display module to be in the operating state, certainly in order to reduce power consumption. When the relative position between the electronic apparatus and the viewer wearing the electronic apparatus sensed by the second sensor satisfies the third relative region, the first display module may be controlled to be in the low power consumption state simultaneously. Likewise, when the relative position between the electronic apparatus and the viewer wearing the electronic apparatus sensed by the second sensor satisfies the third relative region, the first display module is maintained to be in the operating state (at this time, the operating state is the operating state of the controlled first display module in the second relative region). When the relative position between the electronic apparatus and the viewer wearing the electronic apparatus satisfies the first relative region again, the electronic apparatus controls the first display module and the second display module to switch to the low power consumption state (the off state or the standby state);

Here, the associated data content may be understood as the detailed information in the first embodiment and the sixth embodiment. The detailed information may be information generated based on the basic information. Of course, the detailed information may also be information that is not correlated with the basic information. The basic information at least includes time information, the basic information may further include information such as date, temperature etc.

The technical solutions provided by the above-described respective embodiments of the present application not only describe positional relation of the components of the electronic apparatus, but also describe in detail a display principle of the two display modules (the first display module and the second display module) in the electronic apparatus.

The two display modules in the electronic apparatus provided above may have various states in use. Now the electronic apparatus is illustrated as a smart watch worn on the wrist. For example, when a user is walking, he or she droops his or her arm naturally, and then both the first display module and the second display module of the electronic apparatus may be in the low power consumption state such as an off state or a standby state, which can save power to prolong service time of the electronic apparatus. When the arm of the user is in a naturally drooping state, it can be deemed that the electronic apparatus is located in the first relative region, that is to say, the first relative region indicates a relative positional relationship between the user and the electronic apparatus which is the side region of the body of the viewer.

Next, if the user wants to look at the time at a certain moment during walking, then he/she will lift his or her arm. It is assumed that the electronic apparatus is in a second relative region (e.g., the region in front of the breast of the user) when the user lifts his or her arm. At this time, if the electronic apparatus detects itself in the second relative region, it enables the first display module (starts or wake up the first display module), and then displays the time to the user, or displays a prompt message to the user by the first display module.

At this time, if the user wants to see data content more associated with the prompt message, he or she will continue to draw the electronic apparatus to the eyes, and it is assumed that at this time the electronic apparatus is in the third relative region (e.g., the region in front of the head of the user). That is to say, when the electronic apparatus is in the third relative region, the electronic apparatus will enable the second display module. When the user draw his or her eyes close to a light spot 200 formed on the protective layer after the second display module is enabled, the user can see the associated data content from the light spot 200 via the second display module.

The above-described electronic apparatus provided by the seventh embodiment and the eighth embodiment comprises two batteries which are a first battery and a second battery. The display device in the seventh embodiment and the eighth embodiment includes two display modules; with respect to the above the seventh embodiment and the eighth embodiment, an embodiment of the present application provides a power strategy. Under normal circumstances, the second display module is powered by the second battery. When the second battery is out of power, the first battery may supply power for the second display module. For example, when the user is using the electronic apparatus, viewing some very important information by the second display module, and then the second battery is out of power, in order to ensure that user can use the second display module in such time of emergency, the first battery can supply power for the second display module temporarily. That is to say, when the second battery is out of power, the first battery can be used as a buffer or remedy of the second battery.

Generally speaking, the first battery supplies power for the first display module in 24 hours of every day, so as to ensure that the first display module is always in the operating state. When the first display module displays the basic information such as time, the user can see update of the basic information such as time at any time. When the first battery is out of power, the second battery can charge the first battery. Since the first battery is in a state of supplying power for the first display module in 24 hours of every day, when the first battery is lower than a certain capacity threshold, the second battery can charge the first battery, so as to ensure that the first battery has no power outage.

Respective embodiments of the present application provided above are merely illustrative, and in practice, technical features in the respective embodiments can be used in combination as required. Typically, one or more technical features in the sixth embodiment and the seventh embodiment can be added to the first embodiment to the fifth embodiment.

As a first example of such combinations, on the basis of the first embodiment of the electronic apparatus described in conjunction with FIG. 1-1, the technical features in the sixth embodiment described in conjunction with FIG. 6-1 may be combined. That is to say, the first display module and the second display module in the first embodiment may be included in the display device of the electronic apparatus, a power consumption of the first display module is lower than a power consumption of the second display module, and the display device has a low power consumption mode in which the first display module is in an operating state and a high power consumption mode in which the second display module is in an operating state; and the functional main body section further includes a first battery, a second battery and a control circuit. The first battery is disposed in the frame body or disposed in the fixing device. The second battery is disposed in the frame body or disposed in the fixing device. The control circuit is disposed in the frame body or disposed in the fixing device. The control circuit is used for controlling the first battery to supply power for the display device when the display device is in the low power consumption mode, and controlling the second battery to supply power for the display device when the display device is in the high power consumption mode.

As a second example of such combinations, on the basis of the first embodiment of the electronic apparatus described in conjunction with FIG. 1-1 and the sixth embodiment described in conjunction with FIG. 6-1, the functional main body section in the electronic apparatus may further include a sensing device for sensing operation information of an operator of an electronic apparatus. The sensing device is disposed in the frame body or in the fixing device. The sensing device is connected to the control circuit. The control circuit determines whether to start the high power consumption mode of the display device according to the operation information obtained by the sensing device. When it is determined to start the high power consumption mode of the display device according to the operation information obtained by the sensing device, the control circuit controls to enable the high power consumption mode of the display device, and in the meantime controls the second battery to supply power for the display device. When it is determined that it is not necessary to start the high power consumption mode of the display device according to the operation information obtained by the sensing device, the control circuit maintains the low power consumption mode of the display device, and in the meantime maintains the first battery to supply power for the display device. In addition, the control circuit may further be used for controlling the electronic apparatus to be in a first operating mode corresponding to the low power consumption mode of the display device when the display device is in the low power consumption mode, and controlling the electronic apparatus to be in a second operating mode corresponding to the high power consumption mode of the display device when the display device is in the high power consumption mode. A power consumption of the first operating mode of the electronic apparatus is less than the power consumption of the second operating mode of the electronic apparatus.

The above described are only specific embodiments of the present application, but the scope of the present application is not limited thereto. Any person skilled in the art, within the technical scope disclosed by the present application, can easily conceive that variations or replacements should be covered within the protection scope of the present application. Therefore, the protection scope of the present application should be the protection scope of the claims.

The invention claimed is:

1. An electronic apparatus comprising:

a frame body;

a fixing device connected to the frame body to fix the electronic apparatus onto a support body, the frame body and the fixing device forming a ring-like space when the electronic apparatus is fixed onto the support body by the fixing device;

a first display module and a second display module, the first display module being disposed in the frame body and the second display module being disposed in the frame body;

wherein the first display module and a portion of the second display module are stacked sequentially in a first direction; the electronic apparatus has a first cross section being a ring formed by sectioning the electronic apparatus in a direction perpendicular to the support body with the support body as a reference object when the electronic apparatus is fixed onto the support body by the fixing device, the first direction being a direction from an outside of the ring to an inside of the ring and toward a center of the ring, the second display module is an optical projection system, the first portion of the second display module being an optical conduction component, and the second portion of the second display module being a display component and a collimating component;

the optical conduction component is made of a transparent material.

2. The electronic apparatus according to claim 1, wherein the frame body includes a main frame body being projected as a first shape on the support body when the electronic apparatus is fixed onto the support body by the fixing device.

3. The electronic apparatus according to claim 2, wherein the first display module occupies a first portion of a region formed by the first shape, and a first portion of the second display module occupies a second portion of the region formed by the first shape, with an area of the second portion of the region being larger than an area of the first portion of the region; and wherein the first display module and the first portion of the second display module are stacked sequentially in the first direction.

4. The electronic apparatus according to claim 3, wherein the electronic apparatus further comprises a protective layer made of a transparent material and being disposed in the main frame body with a shape of the protective layer being consistent with the first shape, and the protective layer occupying the whole region formed by the first shape;

the protective layer, the first display module and the first portion of the second display module are stacked sequentially in the first direction;

the protective layer protecting the first display module and the first portion of the second display module.

5. The electronic apparatus according to claim 4, wherein the protective layer includes a first protection region and a second protection region, a first display output region of the first display module corresponds to the first protection region, a second display output region of the second display module corresponds to the second protection region, the first protection region being an orthographic projection region of the first display output region on the protective layer, the second protection region including an orthographic projection region of the second display output region on the protective layer, and the first protection region and the second protection region being disposed in parallel.

6. The electronic apparatus according to claim 5, wherein the first protection region corresponds to the first display module; the second protection region corresponds to an excess portion, the excess portion being a portion in the first portion of the second display module that exceeds the first display module.

7. The electronic apparatus according to claim 6, wherein the electronic apparatus further comprises a support structure made of a transparent material and being disposed in the main frame body, the support structure and the first display module being disposed in parallel, the support structure being located between the protective layer and the excess portion, and the support structure supporting the protective layer and the excess portion.

8. The electronic apparatus according to claim 7, wherein the frame body further includes a sub frame body with the sub frame body and the main frame body being formed integrally and a second portion of the second display module is at least disposed in the sub frame body.

9. The electronic apparatus according to claim 8, wherein the first display module is a first display screen to display and output a first to-be-displayed content with a size of the first display screen being a first display output region of the first display module;

the display component displays and outputs a second to-be-displayed content, to project a first light beam in a beam mode and output the first light beam;

the collimating component is used for processing the first light beam projected and outputted in the beam mode, to convert the first light beam into a second light beam and output the second light beam;

the optical conduction component conducting the second light beam in the transparent material of which the optical conduction component is made, wherein the optical conduction component includes a reflecting unit disposed in a specific region of the excess portion, the reflecting unit changing a conducting direction of the second light beam in the transparent material to be projected in a second direction; the second direction is consistent with an output direction of the first to-be-displayed content of the first display screen of the first display module; and the specific region provided with the reflecting unit in the optical conduction component is the second display output region of the second display module.

10. The electronic apparatus according to claim 6, wherein the electronic apparatus further includes a mainboard module and a battery module; the mainboard module and the battery module being disposed in the sub frame body, and the battery module is electrically connected to the mainboard module; and the mainboard module is electrically connected to the first display module and the second display module, respectively.

11. The electronic apparatus according to claim 10, wherein the fixing device is a connecting band made of a flexible material and being movably connected to the frame body; or the fixing device includes a connecting band made of a flexible material and a locking mechanism, the connecting bang being movably connected to the frame body and being fixedly connected to the locking mechanism.

12. The electronic apparatus according to claim 11, wherein the electronic apparatus further includes a data interface for transmitting data and/or transmitting power, the data interface being disposed in the fixing device, wherein the data interface is connected to the battery module through the flexible connecting line and/or the data interface is connected to the mainboard module through the flexible connecting line.

13. The electronic apparatus according to claim 1, wherein a power consumption of the first display module is lower than a power consumption of the second display module, the first display module and the second display module are included in a display device of the electronic apparatus, the display device having a low power consumption mode in which the first display module is in an operating state and a high power consumption mode in which the second display module is in an operating state;

the electronic apparatus further includes a first battery, a second battery and a control circuit, the first battery is disposed in the frame body or disposed in the fixing device;

the second battery is disposed in the frame body or disposed in the fixing device; and, the control circuit is disposed in the frame body or disposed in the fixing device, the control circuit controlling the first battery to supply power for the display device when the display device is in the low power consumption mode, and controlling the second battery to supply power for the display device when the display device is in the high power consumption mode.

14. The electronic apparatus according to claim 13, wherein the electronic apparatus further includes a sensing device sensing operation information of an operator of the electronic apparatus and being disposed in the frame body or in the fixing device;

the sensing device is connected to the control circuit, and the control circuit determines whether to start the high power consumption mode of the display device according to the operation information obtained by the sensing device;

when it is determined to start the high power consumption mode of the display device according to the operation information obtained by the sensing device, the control circuit enables the high power consumption mode of the display device, and in the meantime controls the second battery to supply power for the display device;

when it is determined that it is not necessary to start the high power consumption mode of the display device according to the operation information obtained by the sensing device, the control circuit maintains the low power consumption mode of the display device, and in the meantime maintains the first battery to supply power for the display device.

15. The electronic apparatus according to claim 13, wherein the control circuit further controls the electronic apparatus to be in a first operating mode corresponding to the low power consumption mode of the display device when the display device is in the low power consumption mode, and controls the electronic apparatus to be in a second operating mode corresponding to the high power consumption mode of the display device when the display device is in the high power consumption mode, a power consumption of the first operating mode of the electronic apparatus being less than a power consumption of the second operating mode of the electronic apparatus.

16. The electronic apparatus according to claim 6, wherein the electronic apparatus further includes a mainboard module, a battery module and a flexible connecting line;

the fixing device includes a connecting band made of a flexible material and a locking mechanism, the connecting band being movably connected to the frame body and being fixedly connected to the locking mechanism;

the connecting band has an accommodating space, the mainboard module and the battery module are sequentially disposed in the accommodating space in parallel in accordance with a shape of the accommodating space; the battery module is electrically connected to a first end of the mainboard module through the flexible connecting line; a second end of the mainboard module is led out of the accommodating space of the connecting band through the flexible connecting line and is led into the frame body, to be electrically connected to the first display module and the second display module, respectively.

17. The electronic apparatus according to claim 16, wherein the mainboard module is divided into at least two portions, the at least two portions of the mainboard module being connected by the flexible connecting line, so that the mainboard module coordinates with deformation of the connecting band; and/or the battery module is divided into at least two portions, the at least two portions of the battery module being connected by the flexible connecting line, so that the battery module coordinates with deformation of the connecting band.

18. An electronic apparatus, comprising a frame body and a fixing device, wherein:

the fixing device is connected to the frame body and fixes the electronic apparatus onto a support body, the frame body and the fixing device forming a ring-like space when the electronic apparatus is fixed onto the support body by the fixing device;

the electronic apparatus further includes a display device having a low power consumption mode and a high power consumption mode, a first battery, a second battery and a control circuit, wherein:

the display device is disposed in the frame body, and displays and outputs display content;

the first battery is disposed in the frame body or disposed in the fixing device;

the second battery is disposed in the frame body or disposed in the fixing device;

the control circuit is disposed in the frame body or disposed in the fixing device, the control circuit controlling the first battery to supply power for the display device when the display device is in the low power consumption mode, and controlling the second battery to supply power for the display device when the display device is in the high power consumption mode, wherein the display device includes a first display module and a second display module and wherein the first display module and a portion of the second display module are stacked sequentially in a first direction, the second display module is an optical projection system, the first portion of the second display module being an optical conduction component, and the second portion of the second display module being a display component and a collimating component and the optical conduction component is made of a transparent material.

19. The electronic apparatus according to claim 18, wherein the display device includes a first display module and a second display module, a power consumption of the first display module being lower than a power consumption of the second display module; the first display module is in an operating state when the display device is in the low power consumption state; the second display module is in an operating state when the display device is in the high power consumption state.

20. The electronic apparatus according to claim 18, wherein the electronic apparatus further includes a sensing device that senses operation information of an operator of the electronic apparatus, the sensing device being disposed in the frame body or in the fixing device;

the sensing device is connected to the control circuit, and the control circuit determines whether to start the high power consumption mode of the display device according to the operation information obtained by the sensing device; when it is determined to start the high power consumption mode of the display device according to the operation information obtained by the sensing device, the control circuit controls to enable the high power consumption mode of the display device, and in the meantime controls the second battery to supply power for the display device; when it is determined that it is not necessary to start the high power consumption mode of the display device according to the operation information obtained by the sensing device, the control circuit maintains the low power consumption mode of the display device, and in the meantime maintains the first battery to supply power for the display device.

21. The electronic apparatus according to claim 18, wherein the control circuit further controls the electronic apparatus to be in a first operating mode corresponding to the low power consumption mode of the display device when the display device is in the low power consumption mode, and controls the electronic apparatus to be in a second operating mode corresponding to the high power consumption mode of the display device when the display device is in the high power consumption mode, a power consumption of the first operating mode of the electronic apparatus being less than a power consumption of the second operating mode of the electronic apparatus.

22. The electronic apparatus according to claim 18, wherein the fixing device is a connecting band made of a flexible material and being movably connected to the frame body; or the fixing device includes a connecting band made of a flexible material and a locking mechanism, the connecting band being movably connected to the frame body, and the connecting band being fixedly connected to the locking mechanism.

23. The electronic apparatus according to claim 22, wherein the connecting band has an accommodating space with the control circuit being disposed in the accommodating space in accordance with a shape of the accommodating space; the control circuit is led out of the accommodating space of the connecting band through the flexible connecting line and led into the frame body, and is electrically connected to the first display module and the second display module, respectively.

24. The electronic apparatus according to claim 22, wherein the connecting band has an accommodating space, the first battery and the second battery are sequentially disposed in the accommodating space in parallel in accordance with a shape of the accommodating space; the first battery is electrically connected to a first end of the control circuit through the flexible connecting line; the second battery is electrically connected to the first end of the control circuit through the flexible connecting line; a second end of the control circuit is led out of the accommodating space of the connecting band through the flexible connecting line and led into the frame body, and is electrically connected to the first display module and the second display module, respectively.

* * * * *